US007871155B2

(12) United States Patent
Sasaki

(10) Patent No.: US 7,871,155 B2
(45) Date of Patent: Jan. 18, 2011

(54) FLUID CARTRIDGES AND FLUID AMOUNT DETECTION SYSTEMS

(75) Inventor: Toyonori Sasaki, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 816 days.

(21) Appl. No.: 11/760,278

(22) Filed: Jun. 8, 2007

(65) Prior Publication Data

US 2007/0285484 A1 Dec. 13, 2007

(30) Foreign Application Priority Data

Jun. 8, 2006 (JP) ..... 2006-160113

(51) Int. Cl.
*B41J 2/175* (2006.01)

(52) U.S. Cl. ..... 347/86

(58) Field of Classification Search ..... 347/7, 347/85, 86

See application file for complete search history.

(56) References Cited

U.S. PATENT DOCUMENTS

| | | | | |
|---|---|---|---|---|
| 4,604,633 | A * | 8/1986 | Kimura et al. | 347/7 |
| 6,830,322 | B2 * | 12/2004 | Shihoh et al. | 347/86 |
| 7,506,972 | B2 * | 3/2009 | Aruga | 347/86 |

FOREIGN PATENT DOCUMENTS

| | | | |
|---|---|---|---|
| DE | 3408302 | A1 | 9/1985 |
| EP | 1 619 030 | A2 | 1/2006 |
| JP | S59-115860 | A | 7/1984 |
| JP | 59204567 | A | 11/1984 |
| JP | 60172546 | A | 9/1985 |
| JP | H04-151258 | A | 5/1992 |
| JP | S59-204567 | A | 11/1994 |
| JP | 2004174832 | A | 6/2004 |

OTHER PUBLICATIONS

China Patent Office, Notification of First Office Action in the Chinese Patent Application No. 200710110257.2 (counterpart to the above-captioned U.S. Patent Application) mailed Feb. 27, 2009.

European Patent Office; European Search Report in Application No. 07011143.0 (counterpart to the above-captioned U.S. patent application) mailed Sep. 14, 2009.

European Search Report Received on Oct. 1, 2007, in corresponding European Patent Application No. EP 07011143.0.

* cited by examiner

*Primary Examiner*—Anh T. N. Vo
(74) *Attorney, Agent, or Firm*—Baker Botts L.L.P.

(57) ABSTRACT

A fluid cartridge includes a fluid container, with the fluid container having a fluid chamber configured to store a fluid, a first passage configured to supply a fluid from an interior of the fluid chamber to an exterior, a first flexible sheet portion with first and second surfaces, and a second flexible sheet portion with third and fourth surfaces. The first flexible sheet portion deforms when a pressure difference is greater than or equal to a first value, and the second flexible sheet portion deforms when a pressure difference is greater than or equal to a second value. The fluid cartridge may also be used in a fluid amount detection system, with a light emitting portion, and a light receiving portion, where the second flexible sheet reflects light so that the reflected light reaches the light receiving portion.

21 Claims, 16 Drawing Sheets

FLUID CARTRIDGES AND FLUID AMOUNT DETECTION SYSTEMS

CROSS REFERENCE TO RELATED APPLICATION

The present application claims priority from Japanese Patent Application No. 2006-160113, which was filed on Jun. 8, 2006, the disclosure of which is herein incorporated by reference in its entirety.

BACKGROUND OF THE INVENTION

1. Field of the Invention

The present invention relates to fluid cartridges configured to store fluid, e.g., ink, fuel, gas, or similar fluids, and to fluid amount detections systems configured to detect an amount of fluid in such fluid cartridges.

2. Description of Related Art

A known inkjet recording apparatus performs printing by ejecting ink from a recording head onto a recording medium, and an ink cartridge may be removably mounted to the known inkjet recording apparatus. When a recording head attempts to eject ink from an empty ink cartridge, air may enter into the recording head, which may cause printing failures. Moreover, air entering the recording head may damage the recording head. To reduce the likelihood of such situations occurring, the known inkjet recording apparatus monitors an ink level or an amount of ink in an ink cartridge, and prevents ink ejection from the recording head before the ink in the ink cartridge is depleted.

In the known inkjet recording apparatus, to detect the amount of ink in the ink cartridge, the ink cartridge includes a container formed of a flexible film for storing ink, a case configured to accommodate the container, and a detection plate bonded to a surface of the film of the ink container and configured to slide inside the case. An interior of the container is not in fluid communication with the atmosphere. Therefore, the internal pressure of the container may be reduced as the ink within the container is consumed or reduced. When a difference between the atmospheric pressure and the internal pressure of container reaches or exceeds a threshold value, the film of the container begins deforming in a manner which narrows an interior space of the container. By reducing the volume of the interior space as the ink is depleted, the internal pressure of the interior space of the container may remain constant. As the film deforms, the detection plate bonded to the film of the container moves. By detecting the movement of the detection plate, it is determined that ink within the container is reduced.

Nevertheless, when the amount of ink in the container is sufficiently reduced, the amount of ink in the container may not be accurately determined merely by the detection of the movement of the detection plate.

SUMMARY OF THE INVENTION

Therefore, a need has arisen for fluid cartridges and fluid amount detection systems which overcome these and other shortcomings of the related art. A technical advantage of the present invention is that an amount of fluid in a fluid cartridge is determined accurately.

In an embodiment of the present invention, a fluid cartridge comprises a fluid container comprising a fluid chamber configured to store a fluid, a first passage configured to supply the fluid from an interior of the fluid chamber to an exterior of the fluid chamber therethrough, a first flexible sheet portion comprising a first surface facing an interior of the fluid container, and a second surface facing an exterior of the fluid container, where the first surface is opposite the second surface, and a second flexible sheet portion comprising a third surface facing the interior of the fluid container and a fourth surface, facing the exterior of the fluid container, where the third surface is opposite the fourth surface. The first flexible sheet portion is configured to deform when a pressure acting on the second surface is greater than a pressure acting on the first surface, and when a difference between a pressure acting on the first surface and a pressure acting on the second surface is greater than or equal to a first value, and the second flexible film is configured to deform when a pressure acting on the fourth surface is greater than a pressure acting on the third surface, and when a difference between a pressure acting on the third surface and a pressure acting on the fourth surface is greater than or equal to a second value. The second value is greater than the first value. In an embodiment of the present invention, a case encloses the fluid container, and the case has a first and second opening formed therethrough, and the first opening is configured to be in fluid communication with the fluid outlet passage, and the second opening is configured to provide fluid communication between the second flexible sheet portion and an exterior of the case.

In another embodiment of the present invention, a fluid amount detection system comprises a fluid cartridge comprising a fluid container, comprising a fluid chamber configured to store a fluid, a first passage configured to supply the fluid from an interior of the fluid chamber to an exterior of the fluid chamber therethrough, a first flexible sheet portion comprising a first surface facing an interior of the fluid container, and a second surface facing an exterior of the fluid container, where the first surface is opposite the second surface, and a second flexible sheet portion comprising a third surface facing the interior of the fluid container and a fourth surface, facing the exterior of the fluid container, where the third surface is opposite the fourth surface. The first flexible sheet portion is configured to deform when a pressure acting on the second surface is greater than a pressure acting on the first surface and when a difference between a pressure acting on the first surface and a pressure acting on the second surface is greater than or equal to a first value, and the second flexible film is configured to deform when a pressure acting on the fourth surface is greater than a pressure acting on the third surface and when a difference between a pressure acting on the third surface and a pressure acting on the fourth surface is greater than or equal to a second value. The second value is greater than the first value. The fluid amount detection system also comprises a light emitting portion, and a light receiving portion. The second flexible sheet portion is configured to reflect light, and is positioned so that a light emitted from the light emitting portion and reflected by the second flexible sheet portion reaches the light receiving portion before the second flexible sheet portion deforms.

In another embodiment of the present invention, a fluid cartridge comprises a fluid container comprising a fluid chamber configured to store a fluid, a first passage configured to supply the fluid therethrough from an interior of the fluid chamber to an exterior of the fluid chamber, a first flexible sheet portion defining a first portion of an outer surface of the fluid container, and a second flexible sheet portion defining a second portion of an outer surface of the fluid container, and a flexibility of the first flexible sheet portion is greater than a flexibility of the second flexible sheet portion.

In another embodiment of the present invention, a fluid amount detection system comprises a fluid cartridge comprising a fluid container, comprising a fluid chamber configured to store a fluid, a first passage configured to supply the fluid therethrough from an interior of the fluid chamber to an exterior of the fluid chamber, a first flexible sheet portion defining a first portion of an outer surface of the fluid container, and a second flexible sheet portion defining a second portion of an outer surface of the fluid container, and a flexibility of the first flexible sheet portion is greater than a flexibility of the second flexible sheet portion. The fluid amount detection system also comprises a light emitting portion, and a light receiving portion, and the second flexible sheet portion is positioned such that a light emitted from the light emitting portion and reflected by the second flexible sheet portion reaches the light receiving portion, before the second flexible sheet portion deforms.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the present invention, and their features and advantages, may be understood by referring to FIGS. 1-16, like numerals being used for like corresponding parts in the various drawings.

Figure 1:
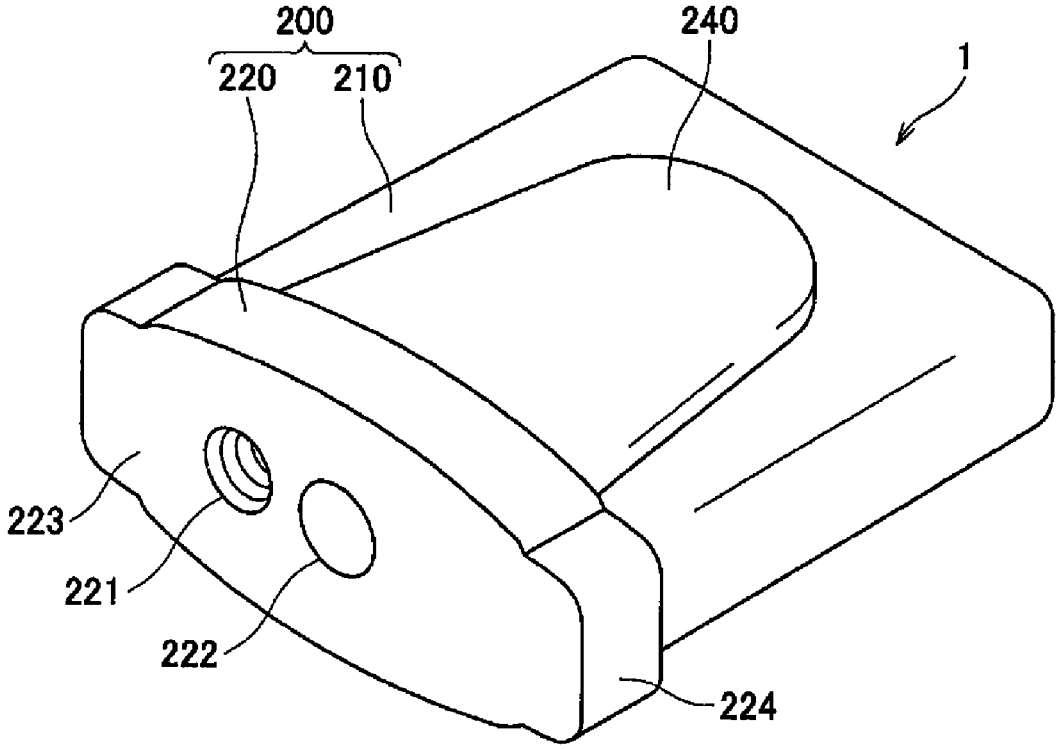
FIG. 1 is a perspective view of an ink cartridge, according to an embodiment of the present invention.
Figure 2A:
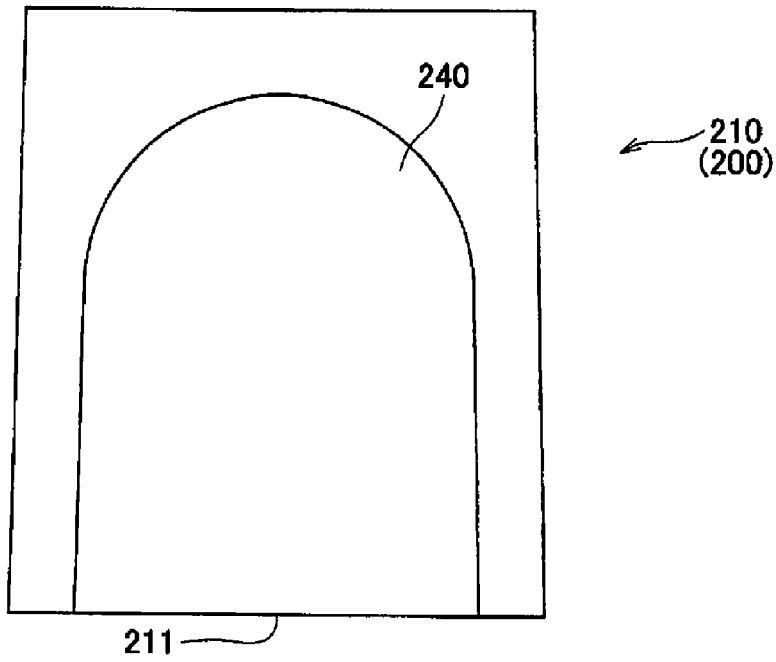
FIGS. 2A-2C are exploded views of the ink cartridge shown in FIG. 1, according to an embodiment of the present invention.

Referring to FIG. 1, according to an embodiment of the present invention, a fluid cartridge, e.g., an ink cartridge 1, may have a substantially hexahedral shape. Ink cartridge 1 may have an ink container 100, and a case 200 configured to accommodate ink container 100. Case 200 may have a body 210 and a cap 220. As shown in FIG. 2A, body 210 may have a box shape with an opening 211, and may be configured to substantially enclose the ink container 100. Cap 220 also may be attached to body 210 to cover opening 211, and may be attached e.g., by welding.

Figure 2B:
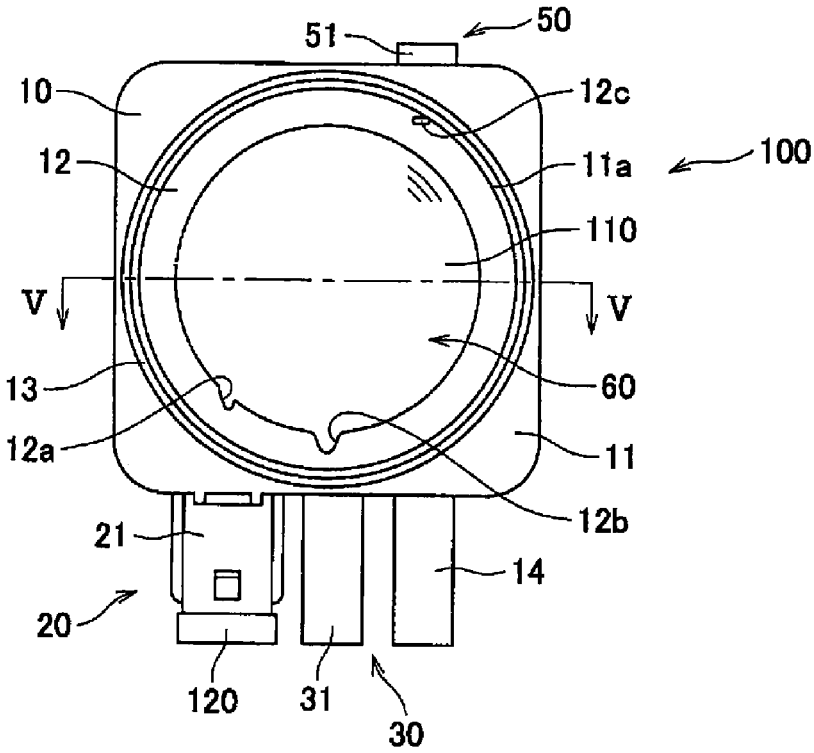
Figure 6B:
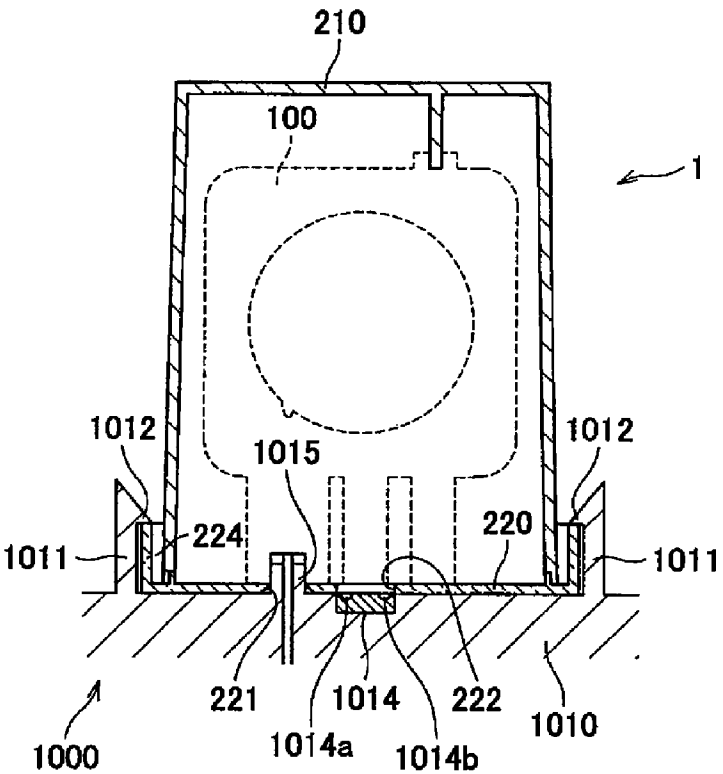
FIGS. 6A and 6B are schematics showing processes of mounting the ink cartridge of FIG. 1 to an inkjet recording apparatus, according to an embodiment of the present invention.
Figure 6A:
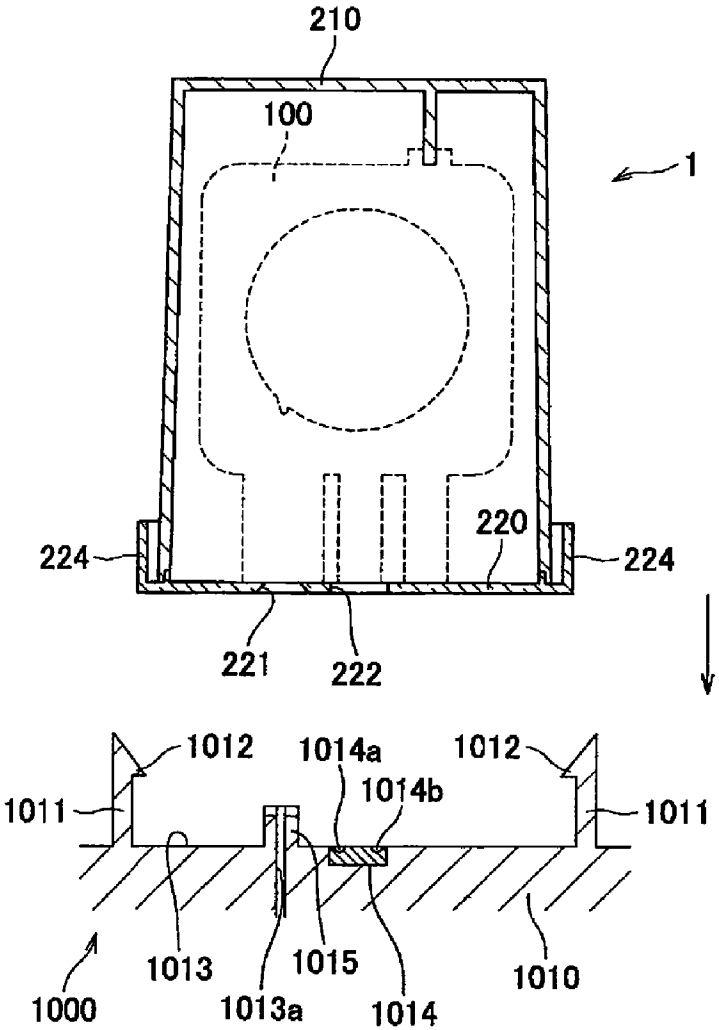

As shown in FIG. 2B, ink container 100 may comprise a frame 10 which may comprise an ink chamber 60, an ink outlet portion 20, a detection portion 30, and an ink dispensing portion 50. Ink may be stored in ink chamber 60, and ink may be supplied from ink chamber 60 through ink outlet portion 20 to an exterior of ink cartridge 1. For example, ink from ink chamber 60 may be supplied to an inkjet recording apparatus 1000, as shown in FIGS. 6A and 6B. Detection portion 30 may be configured to detect the amount of ink remaining in ink chamber 60, and ink may be dispensed to ink chamber 60 through ink dispensing portion 50.

Figure 2C:
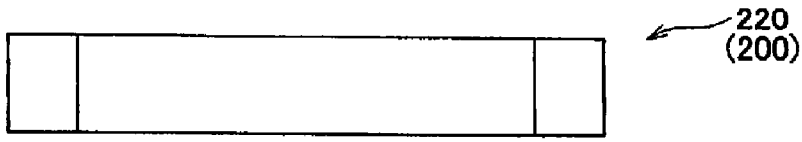

As shown in FIGS. 2A-2C, ink container 100 may be disposed in case 200 with ink outlet portion 20 on the side of cap 220. Ink cartridge 1 may be mounted to inkjet recording apparatus 1000 with cap 220 on the lower side, thus aligning ink outlet portion 20 of ink container 100 to face inkjet recording apparatus 1000. In one embodiment of the present invention, the top, bottom, upper, and lower sides of ink cartridge 1 and ink container 100, as well as their vertical direction and their horizontal direction, may be defined based on the orientation in which ink cartridge 1 (ink container 100) is mounted to inkjet recording apparatus 1000. A direction perpendicular to the vertical and horizontal directions may be defined as a thickness direction of ink cartridge 1 and ink container 100.

Figure 3A:
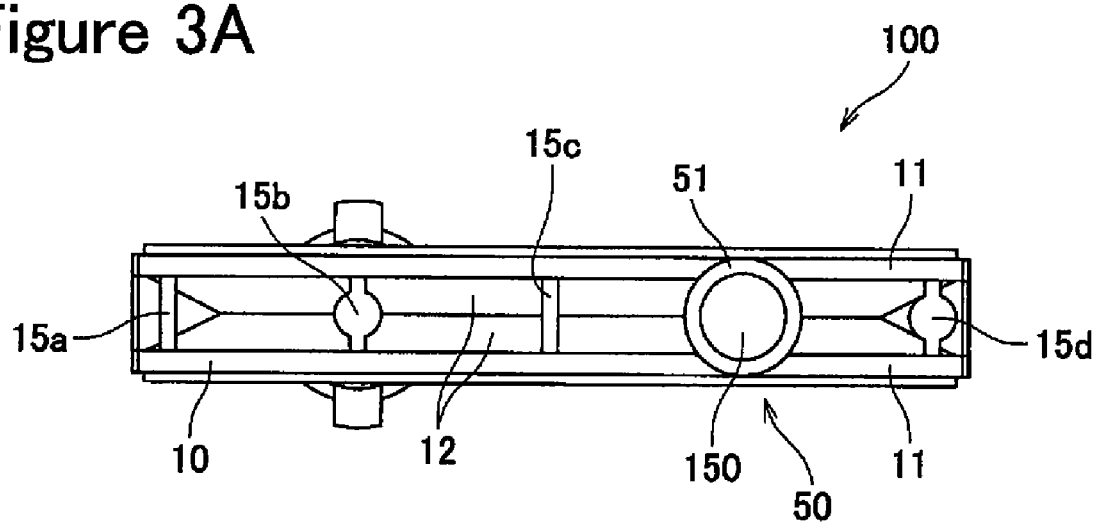
FIGS. 3A and 3B are top and bottom views, respectively, of the ink container shown in FIG. 2B, according to an embodiment of the present invention.
Figure 3B:
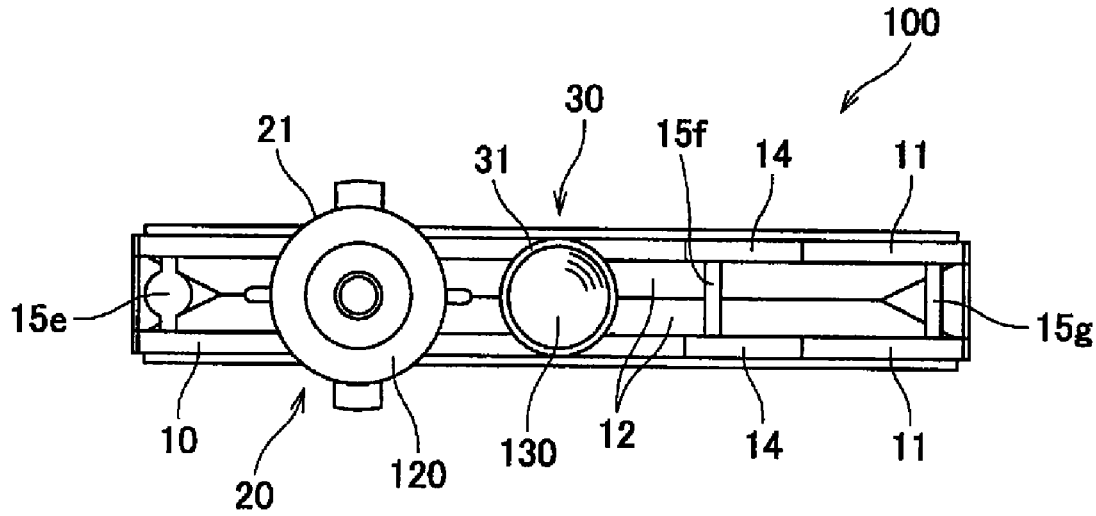

Frame 10 may comprise resin material, such as polyethylene resin, and may be formed using molding techniques. As shown in FIG. 2B, frame 10 may comprise a plate member 11 which may have a substantially square shape. As shown in FIGS. 3A and 3B, two plate members 11 may be disposed to face each other in the thickness direction (illustrated as the top-bottom direction in FIGS. 3A and 3B) of ink container 100. As shown in FIG. 2B, each plate member 11 may have a substantially circular opening 11*a*. A sloping wall 12 may extend radially inwardly from an edge of opening 11*a* of each plate member 11, and approach the opposite sloping wall 12. A diameter of a circle defined by an inner edge of sloping wall 12 may be less than the diameter of opening 11*a*. Sloping walls 12 may connect at the inner edges, as shown in FIGS. 3A, 3B, 5A, and 5B.

As shown in FIG. 2B, a weld portion 13 may be disposed around each opening 11*a*, and film 110 may be welded to weld portion 13. Film 110 may comprise a first flexible layer which may be formed of nylon and a second flexible layer which may be formed of polyethylene. The materials used to form the first layer, the second layer, or both layers may be the same material used to form frame 10. Two films 110 may be welded to frame 10 at weld portions 13, respectively, with a polyethylene layer of each film 110 contacting one of the corresponding weld portions 13, covering and tightly sealing respective openings 11*a*. A space, which may be defined by sloping walls 12 and films 110 covering respective openings 11*a*, may serve as ink chamber 60. Each film 110 may have an inner surface facing an interior of ink container 100, e.g. facing ink chamber 60, and also may have an outer surface opposite the inner surface and facing an exterior of ink container 100.

Figure 5A:
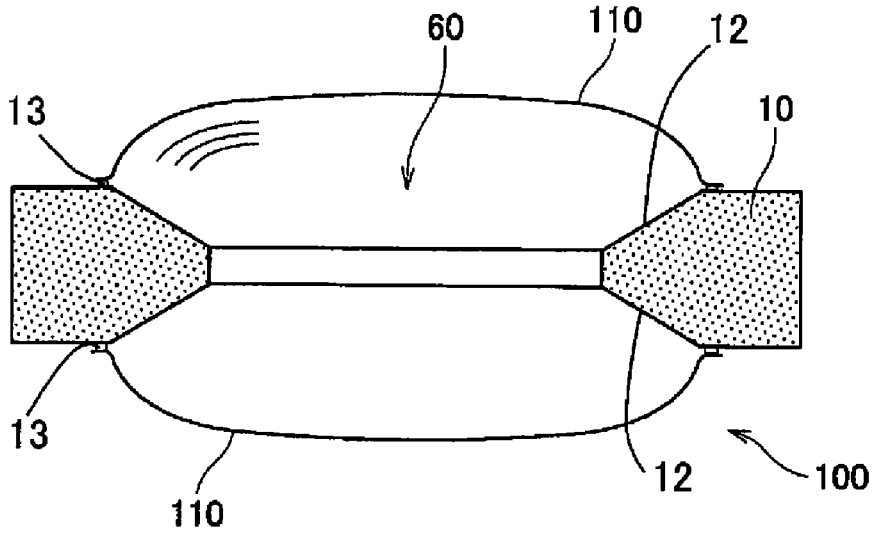
FIGS. 5A and 5B are cross-sectional views of the ink container shown in FIG. 2B, taken along line V-V of FIG. 2B, according to an embodiment of the present invention.
Figure 5B:
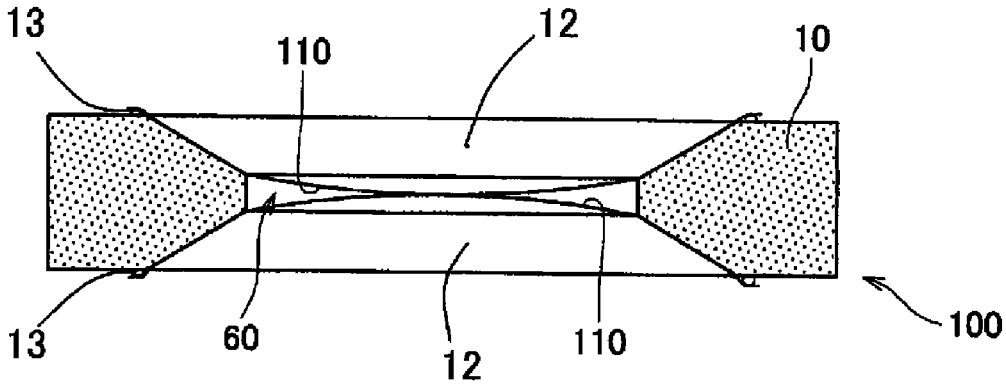

As shown in FIG. 5A, when ink chamber 60 is filled with ink, each film 110 may expand in opposite directions, in the thickness direction of ink container 100, which may cause the films 110 to protrude from a surface of frame 10. When ink cartridge 1 is mounted to inkjet recording apparatus 1000, ink chamber 60 may not be in fluid communication with the atmosphere. Therefore, pressure within ink chamber 60 may decrease proportionally to the consumption or reduction of ink in ink chamber 60. As the pressure within ink chamber 60 decreases, there may be a pressure difference between a pressure P1 acting on the inner surface of film 110 and a pressure P2 acting on the outer surface of film 110, e.g., the atmospheric pressure. When the pressure difference (P2–P1) reaches a first threshold value, flexible films 110 may begin deforming, which may reduce the volumetric capacity of ink chamber 60, proportionally to the reduction of the amount of ink in ink chamber 60. Deformation of films 110 may keep the pressure within ink chamber 60 constant. Thus, ink in ink cartridge 1 may be supplied to and ejected stably and appropriately from a recording head of inkjet recording apparatus 1000. As shown in FIG. 5B, when the amount of ink stored within ink chamber 60 is reduced, films 110 may contact the corresponding sloping walls 12 and also may contact each other at their substantially central portion. In this state, the volumetric capacity of ink chamber 60 may not decrease further, and films 110 may not further deform in a direction which would result in a further narrowing of ink chamber 60.

As shown in FIGS. 2B, 3A, and 3B, ink outlet portion 20 may comprise an ink outlet passage 21 and an ink outlet mechanism 120. Detection portion 30 may comprise a communication passage 31 and a detection film 130, and ink dispensing portion 50 may comprise an ink dispensing passage 51 and an ink dispensing plug 150. Frame 10 may comprise ink outlet passage 21, communication passage 31, and ink dispensing passage 51 which may be disposed in frame 10, opposite the inner edge of sloping walls 12. As shown in FIGS. 2B and 3B, ink outlet passage 21 may extend downward from a left end of the bottom surfaces of plate members 11, and may extend downward between the planes formed by plate members 11. Communication passage 31 may extend downward from a middle portion of bottom surfaces of plate members 11 between the planes formed by plate members 11. Communication passage 31 may be disposed adjacent to and parallel to ink outlet passage 21. As shown in FIGS. 2B and 3A, ink dispensing passage 51 may extend upward from a right end of the upper surfaces of plate members 11 and between the planes formed by plate members 11.

As shown in FIG. 2B, communication openings 12*a* and 12*b* may allow ink outlet passage 21 and communication passage 31, respectively, to be in fluid communication with ink chamber 60. Communication openings 12*a* and 12*b* may be formed in a joint of two sloping walls 12. A communication opening 12*c* which may allow ink dispensing passage 51 to be in fluid communication with ink chamber 60 also may be formed in one of sloping walls 12.

Figure 4:
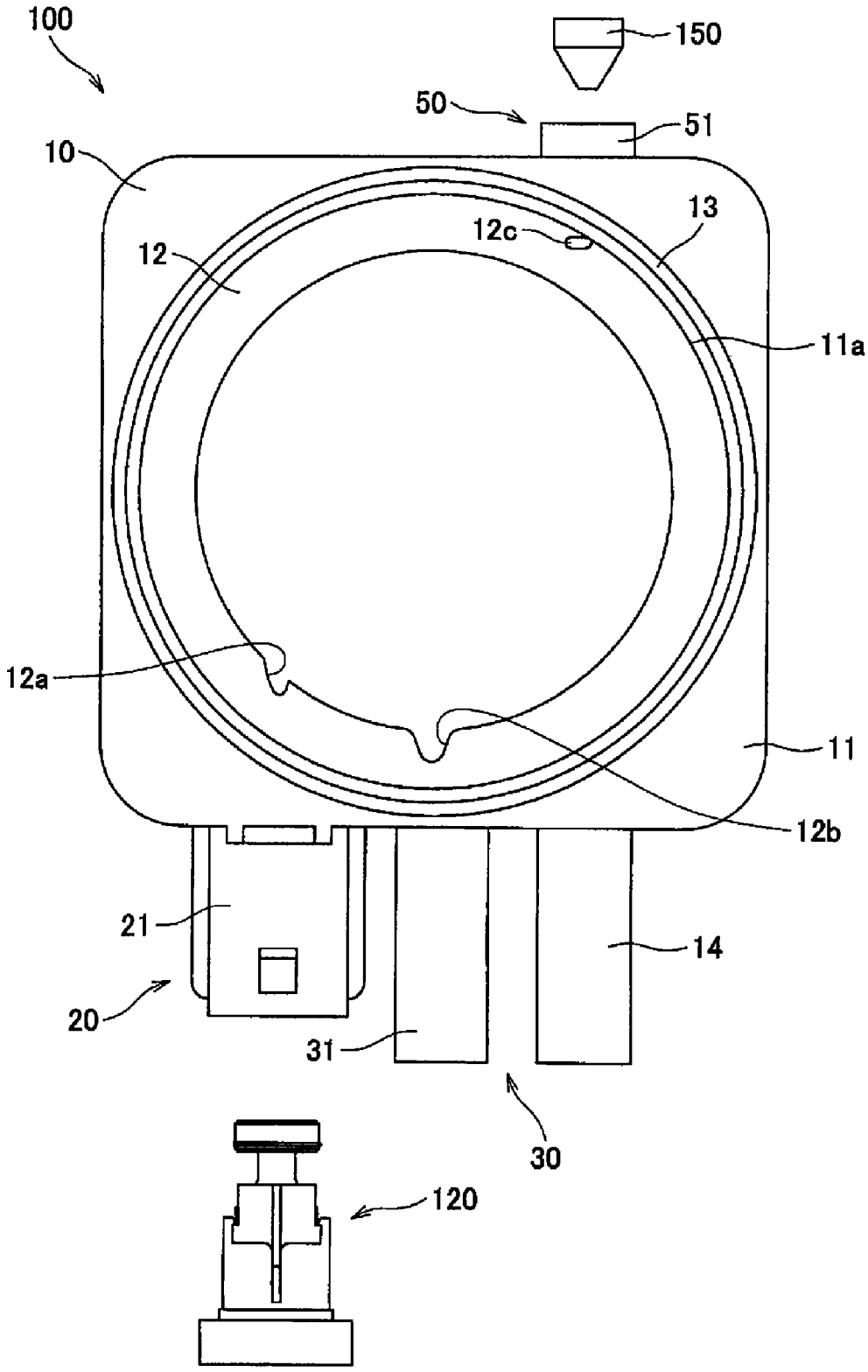
FIG. 4 is an exploded view of the ink container shown in FIG. 2B, according to an embodiment of the present invention.

As shown in FIGS. 3B and 4, a portion of ink outlet mechanism 120 may be inserted into ink outlet passage 21. Ink outlet mechanism 120 may be configured to close an ink passage when ink cartridge 1 is not mounted to inkjet recording apparatus 1000, and to open the ink passage when ink cartridge 1 is mounted to inkjet recording apparatus 1000. Moreover, an ink extracting tube 1015 (shown in FIG. 6A) may be inserted into ink outlet mechanism 120, such that ink in ink chamber 60 may be supplied to inkjet recording apparatus 1000 through ink outlet passage 21 when ink cartridge 1 is mounted thereto.

Communication passage 31 may be in fluid communication with ink chamber 60 through communication opening 12*b* and has a lower end opening opposite communication opening 12*b*. Detection film 130 may be welded to communication passage 31, and may cover the lower end opening of communication passage 31, as shown in FIG. 3B. When ink cartridge 1 is mounted to inkjet recording apparatus 1000, detection film 130 may be positioned to face an ink amount detection sensor 1014 (shown in FIGS. 6A and 6B) provided in inkjet recording apparatus 1000. Detection film 130 may comprise a polyester film, e.g., polyethylene terephthalate (PET) film, on which aluminum may be evaporated. Detection film 130 may have a light reflectivity and a flexibility, and a surface area of detection film 130 may be less than the surface area of each individual film 110. A rigidity of detection film 130 may be greater than that of film 110, and film 110 may be more flexible than film 130. Film 130 may be positioned such that an inner surface of film 130 faces the interior of ink container 100, and an outer surface, opposite the inner surface, faces the exterior of ink container 100. When ink cartridge 1 is in use, a pressure difference may be produced between a pressure P3 acting on the inner surface of film 130 and a pressure P4 acting on the outer surface of film 130, e.g., the atmospheric pressure. When the pressure difference (P4–P3) reaches a second threshold value, film 130 may begin deforming and move toward the interior of ink container 100. The second threshold value may be greater than the first threshold value.

As shown in FIGS. 3A and 4, ink dispensing plug 150 may be inserted into ink dispensing passage 51. Ink dispensing plug 150 may comprise an elastic material. Before ink container 100 is assembled with case 200, ink dispensing plug 150 may be fitted into an upper end portion of ink dispensing passage 51. The upper end may be the end furthest from ink chamber 60. An ink dispensing needle (not shown) may be inserted through ink dispensing plug 150 to dispense ink into ink chamber 60. After ink is dispensed into ink chamber 60, ink container 100 may be assembled with case 200. Ink dispensing plug 150 may be pressed down by a protrusion formed on body 210 of case 200 into a lower end of ink dispensing passage 51 when ink container 100 is assembled with case 200.

As shown in FIG. 4, ink outlet passage 21 and communication passage 31 may have different lengths, and their lower ends may not align with each other. As shown in FIG. 2B, the lower end of communication passage 31 (which may include detection portion 30) may align with the lower end of ink outlet portion 20, where ink outlet portion 20 may have ink outlet mechanism 120 partially inserted into ink outlet passage 21.

A pair of frame regulating members 14 may extend downward from a lower end of respective plate members 11. More specifically, frame regulating members 14 may be disposed opposite ink outlet passage 21 with respect to communication passage 31, and may extend parallel to ink outlet passage 21 and communication passage 31. The lower end of each regulating member 14 may align with the lower ends of communication passage 31 (which may include detection portion 30) and ink outlet portion 20, where ink outlet portion 20 may have ink outlet mechanism 120 partially inserted into ink outlet passage 21. Each plate member 11 may comprise a thin plate. To reinforce the rigidity of plate members 11, ribs 15*a*-15*g* may be provided between plate members 11, as shown in FIGS. 3A and 3B.

Referring back to FIG. 1, a curve portion 240 may curve outward on one of the surfaces of body 210. Specifically, curve portion 240 may curve outward on the surface of body 210 having the largest area among the surfaces of body 210. Curve portions 240 may be formed to accommodate ink container 100, which may have films 110 expanded or swollen due to ink chamber 60 being filled with ink.

Cap 220 may comprise a cover member 223 and a sidewall 224. Cover member 223 may have an area slightly greater than that of opening 211 of body 210 and cover opening 211. Sidewall 224 may extend from an edge of cover member 223. When cap 220 is fitted on body 210, sidewall 224 may contact an outer surface of body 210. As shown in FIG. 1, cover member 223 may have an ink supply hole 221 and an exposure hole 222 at positions which may correspond to the positions of ink outlet portion 20 and detection portion 30, respectively, when ink container 100 is accommodated in the case 200. Ink supply hole 221 may be in fluid communication with ink outlet passage 21, and exposure hole 222 may expose detection film 130 therefrom to an exterior of ink cartridge 1. A pair of cap regulating members (not shown) may be disposed on cover member 223 at positions which may correspond to the positions of a pair of frame regulating members 14 of ink container 100 when ink container 100 is accommodated in the case 200. Each cap regulating member may contact respective frame regulating members 14 when body 210 (accommodating ink container 100 therein) is covered with cap 220. Thus, the movement of ink container 100 inside case 200 in the thickness direction of ink cartridge 1 may be regulated.

Referring to FIGS. 6A and 6B, a mounting of ink cartridge 1 to inkjet recording apparatus 1000, according to an embodiment of the present invention, is described herein. Ink cartridge 1 may be mounted to a mounting portion 1010 of inkjet recording apparatus 1000. Mounting portion 1010 may comprise a mounting surface 1013 and a pair of clamp members 1011 which may extend from mounting surface 1013. Each clamp member 1011 also may comprise a hook portion 1012 disposed at its tip, and each hook portion 1012 may be positioned to face opposite hook portion 1012. Hook portions 1012 may be configured to engage sidewall 224 of cap 220 when ink cartridge 1 is mounted to mounting portion 1010. Each clamp member 1011 may be flexible, in order to allow cap 220 to move clamp members 1011 in a direction away from each other when ink cartridge 1 is mounted to mounting portion 1010.

Ink amount detection sensor 1014 may be disposed in mounting portion 1010, as shown in FIGS. 6A and 6B. Ink amount detection sensor 1014 may comprise a light emitting portion 1014*a* configured to emit light, and a light receiving portion 1014*b* configured to receive light emitted from light emitting portion 1014*a*. Light emitting portion 1014*a* and light receiving portion 1014*b* may be mounted to mounting surface 1013. Ink amount detection sensor 1014 may detect an intensity of light emitted from light emitting portion 1014*a* and received by light receiving portion 1014*b*. When the intensity of the received light is equal to or greater than a light intensity threshold level, ink amount detection sensor 1014 may not output a signal to a determining mechanism, e.g., a circuit board (not shown) of inkjet recording apparatus 1000. When the intensity of the received light is less than the light intensity threshold level, ink amount detection sensor 1014 may output a signal to the circuit board of inkjet printer 1000. In another embodiment of the present invention, ink amount detection sensor 1014 may output a signal to the circuit board when the intensity of the received light is greater than or equal to the threshold level, and may not output a signal to the circuit board when the intensity of the received light is less than the threshold level.

Ink extracting tube 1015 may protrude from mounting surface 1013 at a position corresponding to ink outlet portion 20, as shown in FIG. 6A. Ink extracting tube 1015 may be in fluid communication with an ink channel 1013*a*. Ink within ink cartridge 1 may be supplied through ink channel 1013*a* to an ink ejection opening formed in a recording head (not shown) of ink jet recording apparatus 1000. When ink cartridge 1 is mounted to mounting portion 1010, as shown in FIG. 6B, ink extracting tube 1015 may be inserted into ink outlet portion 20 through ink supply hole 221 formed on cap 220. Thus, ink may be supplied from ink cartridge 1.

Figure 7A:
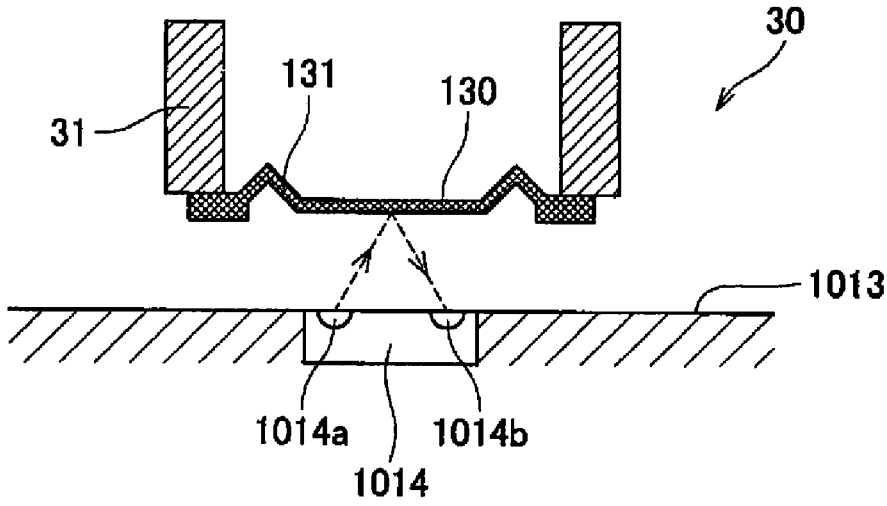
FIGS. 7A and 7B are schematics showing processes for detecting the amount of ink remaining in the ink cartridge shown in FIG. 1, according to an embodiment of the present invention.
Figure 7B:
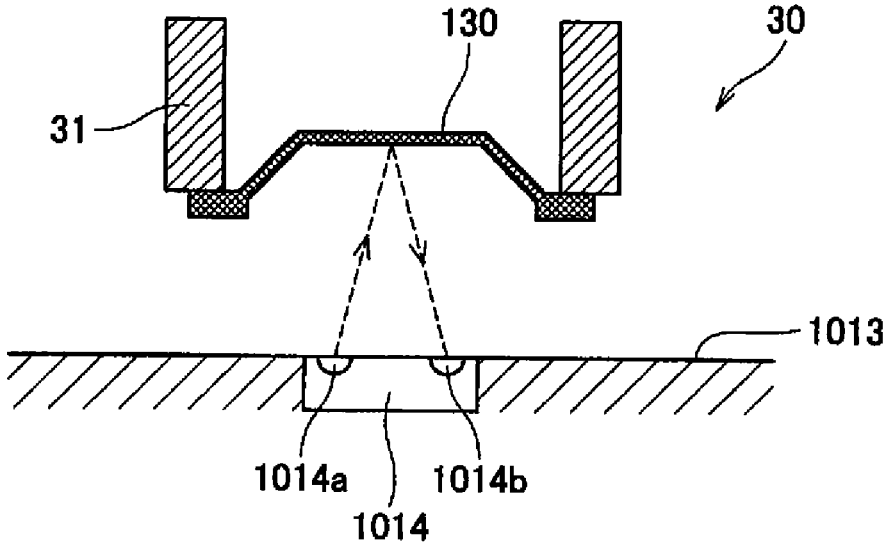

Detection of an ink amount of ink cartridge 1 according to an embodiment of the present invention is herein described with reference to FIGS. 7A and 7B. FIGS. 7A and 7B show ink amount detection sensor 1014 and detection film 130 facing each other when ink cartridge 1 is mounted to inkjet recording apparatus 1000.

When a sufficient amount of ink remains in ink chamber 60, a portion of film 130 may be flexed, as shown in FIG. 7A. More specifically, at least one annular protruding portion 131 may be formed in detection film 130, extending toward the interior of ink container 100. A light emission area of a middle portion of detection film 130 may be irradiated with light emitted from light emitting portion 1014*a*. The light emission area may be substantially flat and substantially parallel to mounting surface 1013, to which light emitting portion 1014*a* and light receiving portion 1014*b* are mounted. Therefore, when the light emission area is in this position, the light may be reflected off the light emission area and received by light receiving portion 1014*b*. When an ink amount in ink cartridge 1 is sufficient, the intensity of the received light may be greater than or equal to the threshold level. Accordingly, the circuit board of inkjet recording apparatus 1000 may determine that ink cartridge 1 has a sufficient amount of ink for normal operation.

As ink within ink chamber 60 is reduced, the interior pressure of ink chamber 60 may decrease. Films 110 may begin deforming when the pressure difference (P2−P1) reaches the first threshold value in order to maintain the interior pressure of ink chamber 60, or to offset the decrease of the interior pressure. Because the second threshold vale is greater than the first threshold vale, even when film 110 begins deforming, detection film 130 may not deform. In this state, the intensity of the light received by light receiving portion 1014*b* may be equal to or greater than the light intensity threshold level. Therefore, the circuit board of inkjet recording apparatus 1000 may determine that the ink cartridge 1 has a sufficient amount of ink for normal operation.

When ink within ink chamber 60 is reduced further, for example, as shown in FIG. 5B, films 110 may no longer deform in a direction which reduces the volumetric capacity of ink chamber 60. In this state, if the amount of ink within ink chamber 60 is further reduced, the interior pressure of ink chamber 60 may decrease, but films 110 may not further deform to offset the decrease of the interior pressure. Accordingly, the interior pressure may continue to decrease and reach a sufficient level to cause detection film 130 to deform. Specifically, when the pressure difference (P4–P3) reaches the second threshold value, detection film 130 may begin deforming. When detection film 130 begins deforming, the light emission area of detection film 130 may be pulled toward the interior of ink container 100 while continuing to be positioned substantially parallel to mounting surface 1013, as shown in FIG. 7B. As detection film 130 deforms, the distance between ink amount detection sensor 1014 and the light emission area of deformed detection film 130 (illustrated in FIG. 7B) may increase, as compared to the distance between ink amount detection sensor 1014 and the light emission area of detection film 130 that has not been deformed (illustrated in FIG. 7A). Accordingly, the intensity of the received light may decrease, and become less than the light intensity threshold level. In this state, the circuit board of inkjet recording apparatus 1000 may determine that ink cartridge 1 is empty.

As described above, ink container 100 may comprise ink chamber 60 which has a space for storing ink, which is defined by sloping walls 12 and two films 110. Films 110 may be configured to deform in a direction which decreases the volumetric capacity of ink chamber 60, proportionally to the consumption or reduction of ink stored within ink chamber 60. Frame 10 may comprise communication passage 31, which is in fluid communication with ink chamber 60. A lower end opening of communication passage 31 may be covered with flexible detection film 130. Detection film 130 may begin deforming when the pressure difference (P4–P3) reaches the second threshold value, which is greater than the first threshold value. Therefore, films 110 may begin deforming in a direction which decreases the volumetric capacity of ink chamber 60 before film 130 begins deforming. When ink within ink chamber 60 is further reduced from a state in which ink remaining in ink chamber 60 is relatively small, and films 110 cannot further deform in the direction to narrow ink chamber 60, detection film 130 may begin deforming. Thus, the reduction of ink within ink chamber 60 may be determined by detecting the deformation of detection film 130.

One or more portions of detection film 130 may be flexed before defection film 130 deforms. The flexed portion or plurality of flexed portions may allow detection film 130 to have some tolerance for deformation. Therefore, a deformation range of detection film 130 may relatively increase and deformation of detection film 130 may be detected reliably. The flexed portion of film 130 may define a plurality of annular protruding portions 131 that extend toward the interior of ink container 100. The plurality of annular protruding portions may allow detection film 130 to deform smoothly toward the interior of ink container 100.

Case 200, which accommodates ink container 100 therein, may have ink supply hole 221 in fluid communication with ink outlet passage 21, and an exposure hole 222 which may expose detection film 130 to an exterior of ink cartridge 1. Therefore, detection film 130 may be readily accessed from an exterior of ink cartridge 1, e.g., from inkjet recording apparatus 1000.

In an embodiment of the present invention, ink supply hole 221 and exposure hole 222 may be formed in a flat end of case 200. Therefore, ink extracting tube 1015, which may be configured to extract ink through ink supply hole 221, and ink amount detection sensor 1014, which may be configured to detect the ink amount of ink cartridge 1 via exposure hole 222, may be disposed on the same plane as the side of inkjet recording apparatus 1000 which faces the end of case 200, when ink cartridge 1 is mounted to inkjet recording apparatus 1000. Thus, the size of the inkjet recording apparatus may be reduced.

Detection film 130 may have light reflectivity. Detection portion 30 may be disposed, such that when ink cartridge 1 is mounted to inkjet recording apparatus 1000, detection film 130 is positioned in an optical path of ink mount detection sensor 1014. This configuration allows deformation of detection film 130 to be readily detected using a relatively uncomplicated structure. A surface area of each film 110 defining ink chamber 60 may be greater than a surface area of detection film 130. Thus, the volumetric capacity of ink chamber 60 may fluctuate over a wider range of variables due to the deformation of films 110. Therefore, a sufficient amount of ink may be stored in ink chamber 60, and reduction of the amount of ink within ink chamber 60 may be reliably detected.

Figure 8A:
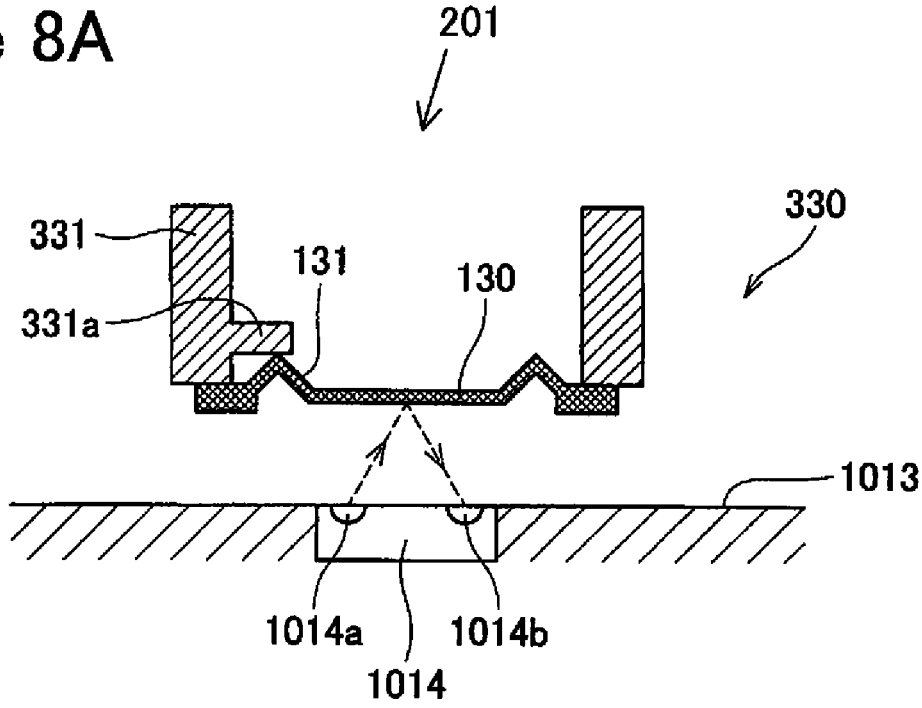
FIGS. 8A and 8B are schematics showing processes for detecting the amount of ink remaining in an ink cartridge, according to another embodiment of the present invention.
Figure 8B:
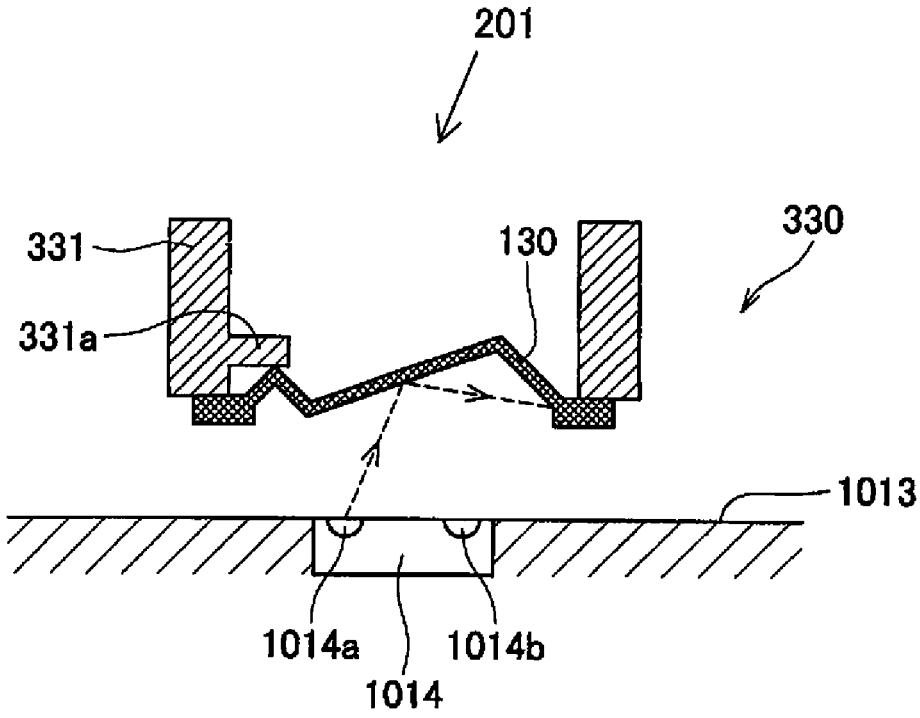

FIGS. 8A and 8B illustrate an ink cartridge 201 according to another embodiment of the present invention described herein. Ink cartridge 201 may be substantially similar to ink cartridge 1. Therefore, only the differences between ink cartridge 201 and ink cartridge 1 are discussed with respect to ink cartridge 201.

Ink cartridge 201 may comprise a detection portion 330 which may be used to detect an ink amount in ink chamber 60. Detection portion 330 may comprise a substantially cylindrical communication passage 331 and a detection film 130, which may be attached to communication passage 331 to cover a lower end opening of communication passage 331. Communication passage 331 may have a regulation member 331*a* which extends laterally toward a center line of communication passage 331 from a position adjacent to the lower end opening of communication passage 331. Regulation member 331*a* may contact a portion of annular protruding portion 131 formed in detection film 130.

When a sufficient amount of ink for normal operation is stored in ink chamber 60, as shown in FIG. 8A, the light emission area of detection film 130 may be substantially flat and substantially parallel to mounting surface 1013 to which light emitting portion 1014*a* and light receiving portion 1014*b* of ink amount detection sensor 1014 are mounted. The light emitted from light emitting portion 1014*a* may be reflected off detection film 130 and received by light receiving portion 1014*b*. When an ink amount of ink cartridge 1 is sufficient for normal operation, the intensity of the received light may be greater than or equal to the light intensity threshold level. Accordingly, the circuit board of inkjet recording apparatus 1000 may determine that the amount of ink within ink cartridge 201 is sufficient for normal operation.

As ink within ink chamber 60 is reduced, the interior pressure of ink chamber 60 may decrease. Films 110 may begin deforming when the pressure difference (P2–P1) reaches the first threshold value. Detection film 130 may begin deforming when the pressure difference (P4–P3) reaches the second threshold value, which is greater than the first threshold value. Therefore, even when films 110 begin deforming, detection film 130 may not deform. In this state, the intensity of the light received by light receiving portion 1014*b* may continue to be greater than or equal to the light intensity threshold level. Therefore, the circuit board of inkjet recording apparatus 1000 may determine that the amount of ink within ink cartridge 201 is sufficient for normal operation, even when films 110 begin deforming.

As ink within ink chamber 60 is reduced further, and ink chamber 60 reaches a state in which films 110 do not deform any further, the interior pressure of ink chamber 60 reaches a level sufficient to cause detection film 130 to deform. Specifically, when the pressure difference (P4–P3) reaches the second threshold vale, detection film 130 may begin deforming. As detection film 130 begins deforming, a portion of detection film 130 which does not contact regulation member 331*a* may be pulled toward the interior of ink container 100, as shown in FIG. 8B. With regulation member 331*a*, detection film 130 may deform asymmetrically. Specifically, detection film 130 may deform asymmetrically with respect to a vertical line passing through the center of detection film 130. Therefore, a substantially middle portion of detection film 130, e.g. the light detection area, may be positioned at an angle with respect to mounting surface 1013. As shown in FIG. 8B, the light emitted from light emitting portion 1014*a* may be reflected from detection film 130 in a direction that may not reach light receiving position 1014*b*. Consequently, light receiving portion 1014*b* may not receive the light. Accordingly, the circuit board of inkjet recording apparatus 1000 may determine that ink cartridge 201 is empty.

In yet another embodiment of the present invention, ink cartridge 201 may comprise regulation member 331*a*, which may regulate a deformation of a portion of detection film 130, such that detection film 130 deforms asymmetrically. With regulation member 331*a*, directions of the light reflected from detection film 130 that has not been deformed, and deformed detection film 130, may be different. When light receiving portion 1014*b* receives a sufficient amount of the reflected light, the circuit board of inkjet recording apparatus 1000 may determine that the amount of ink within ink cartridge 201 is sufficient. When light receiving portion 1014*b* does not receive a sufficient amount of the reflected light, the circuit board may determine that the ink cartridge 201 is empty. In an embodiment of the present invention, regulation member 331*a* may contact a portion of detection film 130, so that detection film 130 may deform asymmetrically.

The accuracy of detecting the deformation of detection film 130 of ink cartridge 1 may depend on the signal-to-noise ratio (S/N) of light reflected from detection film 130 of ink cartridge 1.

Figure 9A:
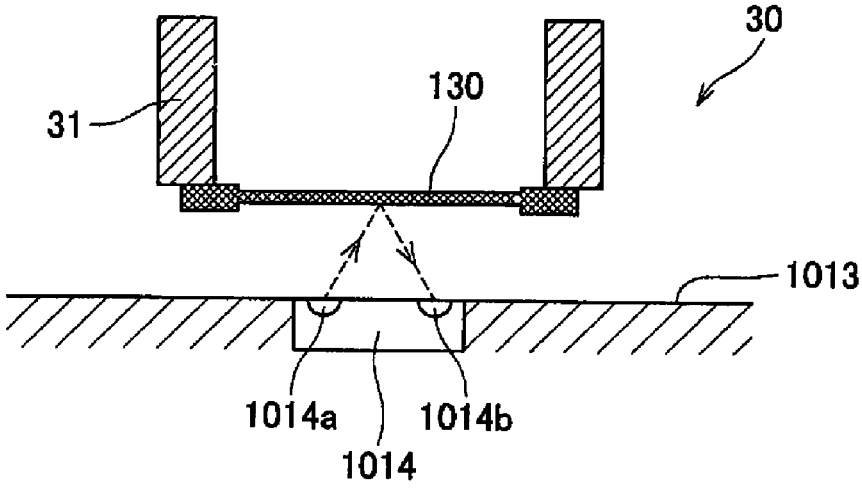
FIGS. 9A and 9B are schematics showing processes for detecting the amount of ink remaining in an ink cartridge, according to yet another embodiment of the present invention.
Figure 9B:
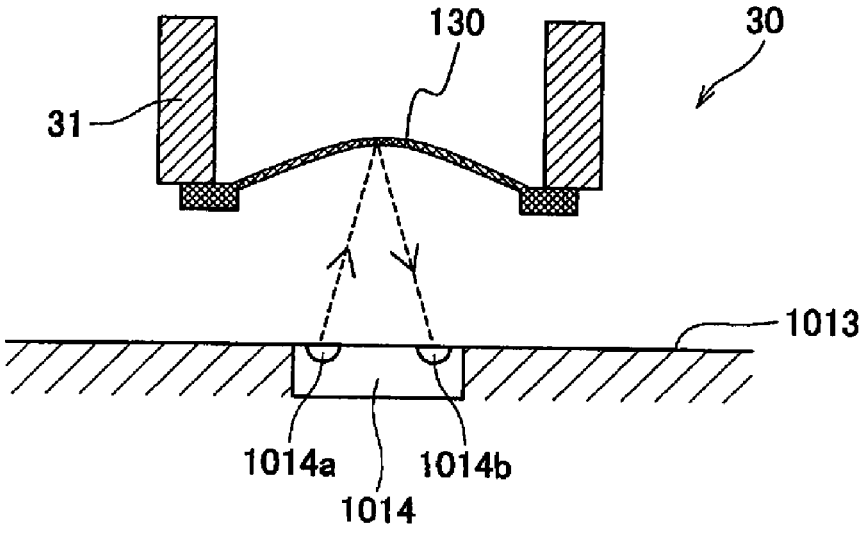

In another embodiment of the present invention, annular protruding portion 131 may extend toward the interior of ink container 100, and may be formed in detection film 130. The shape of protruding portion 131 is not limited to the annular shape, and may have any suitable shape. Moreover, in some embodiments of the present invention, detection film 130 may not have a protruding portion. For example, as shown in FIGS. 9A and 9B, the entirety of film 130 may be flat prior to film 130 deforming, and as film 130 deforms, film 130 may deform toward the interior of ink container 100 in a bowl shape.

In the above embodiments, ink supply hole 221, which may be in fluid communication with ink outlet passage 21, and exposure hole 222, which may expose detection film 130 of detection portion 30 to the outside atmosphere 330 therefrom, may be formed on the same end of case 200 (configured to accommodate ink chamber 100). Nevertheless, ink supply hole 221 and exposure hole 222 also may be formed on different ends of case 200 in other embodiments of the present invention.

In the above embodiments, deformation of detection film 130 may be detected without contacting detection film 130 using an optical sensor, such as ink amount detection sensor 1014. However, a contact-type sensor configured to detect deformation of detection film 130 by contacting thereto also may be used in other embodiments of the present invention.

Figure 10A:
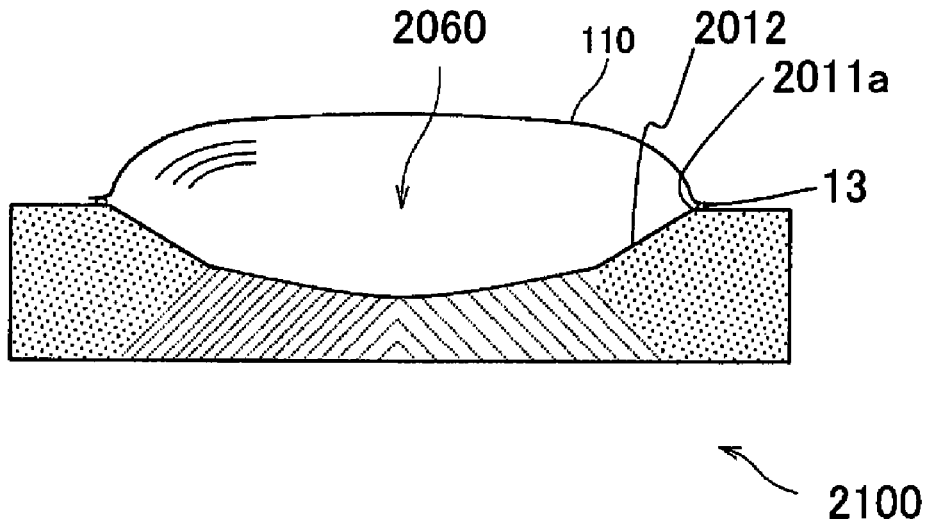
FIGS. 10A and 10B are cross-sectional views of an ink container, according to still another embodiment of the present invention.
Figure 10B:
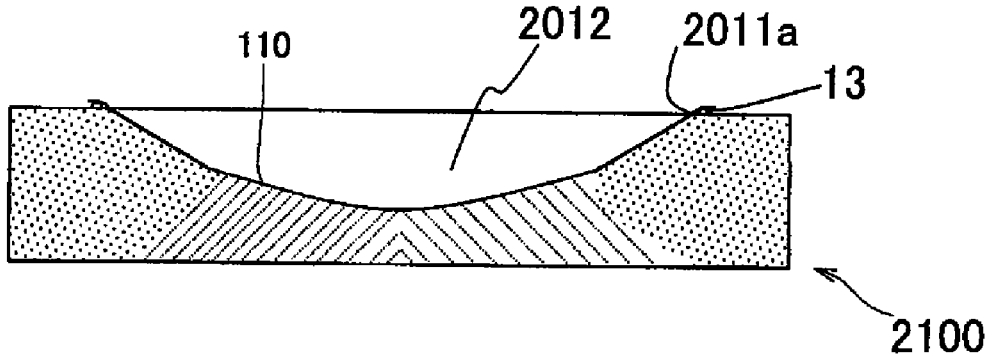
Figure 11:
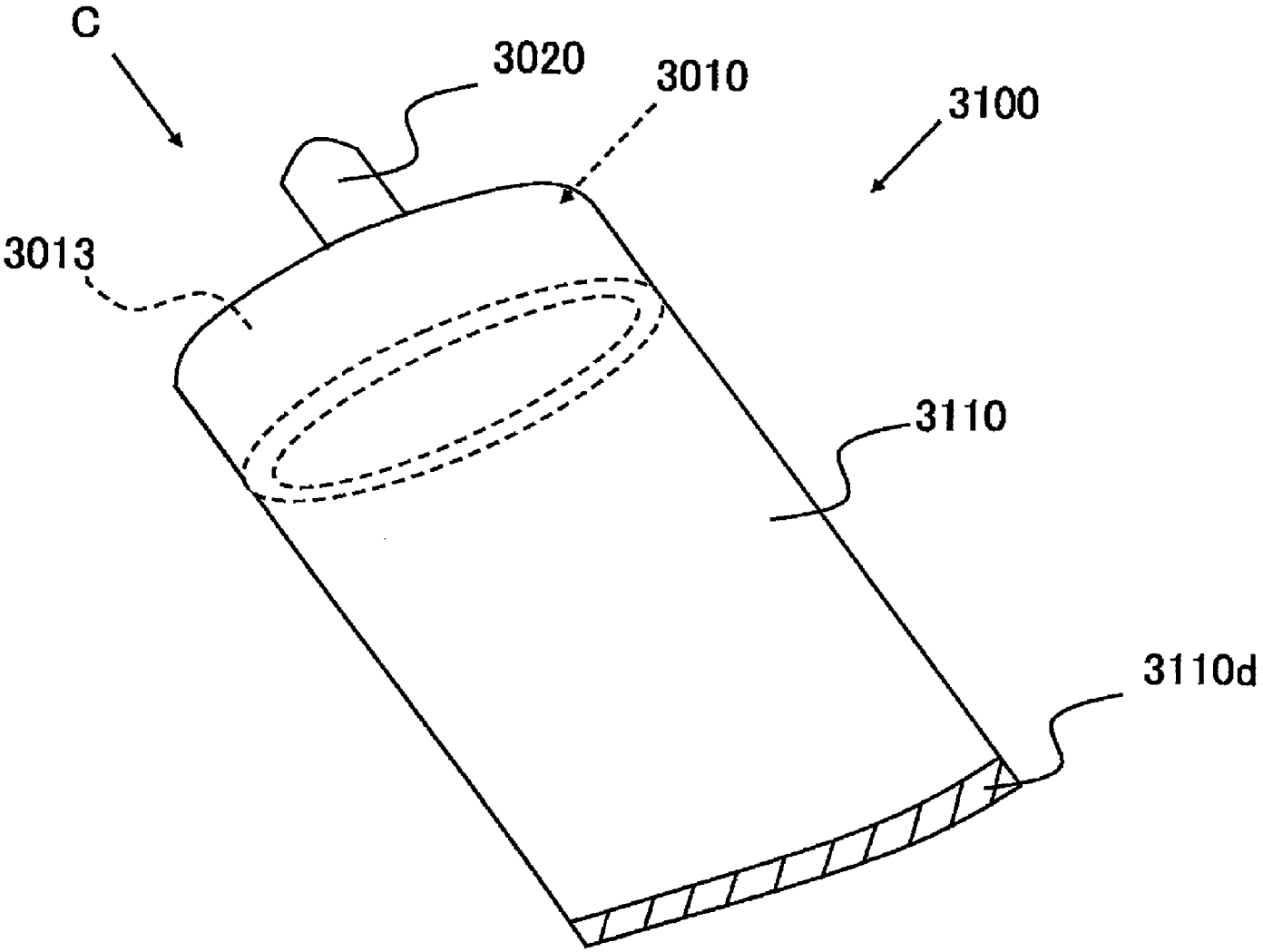
FIG. 11 is a perspective view of an ink container, according to another embodiment of the present invention.
Figure 12:
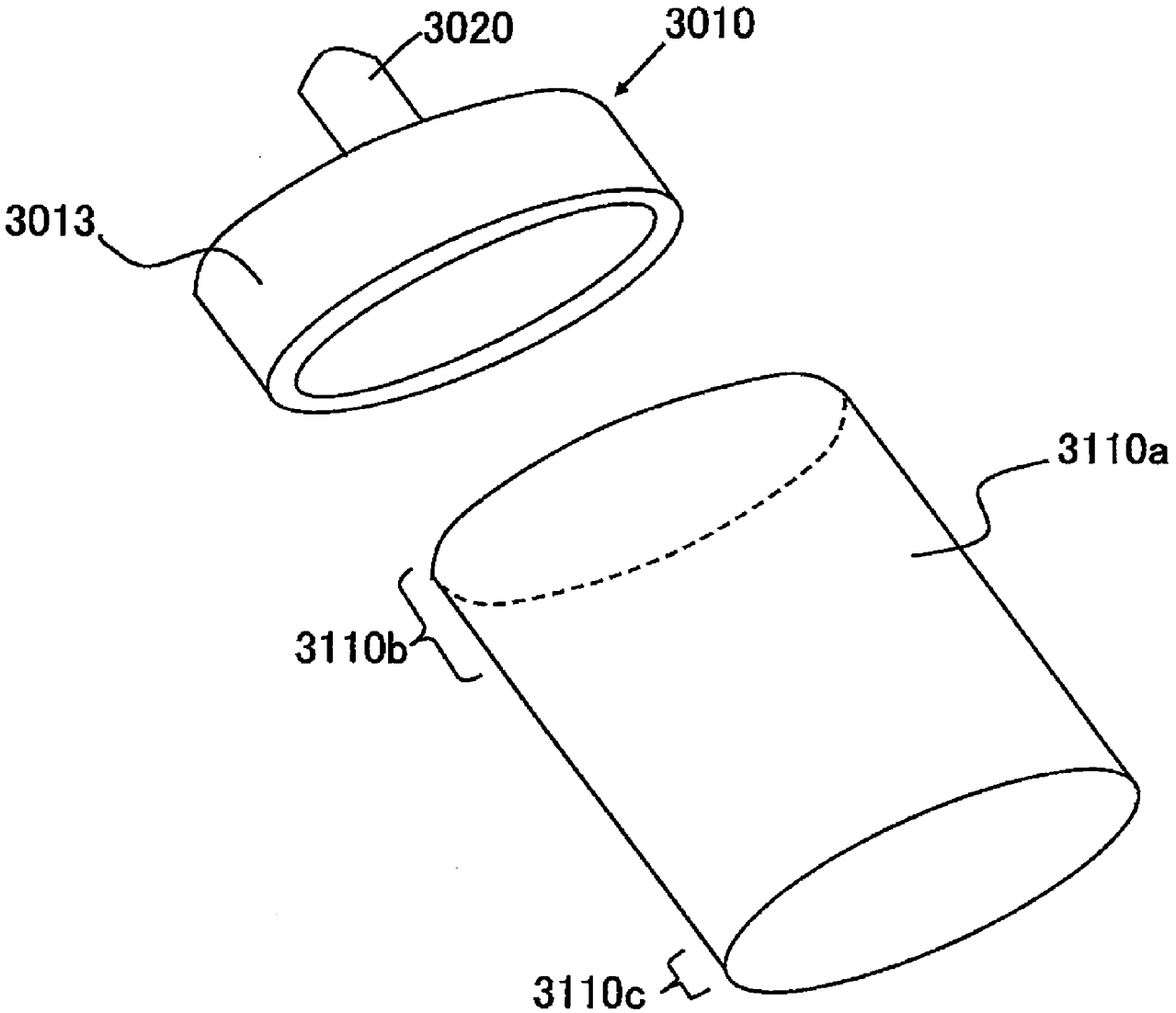
FIG. 12 is a perspective view of a base portion and cylindrical flexible sheet used in forming the ink container of FIG. 1, according to an embodiment of the present invention.
Figure 13:
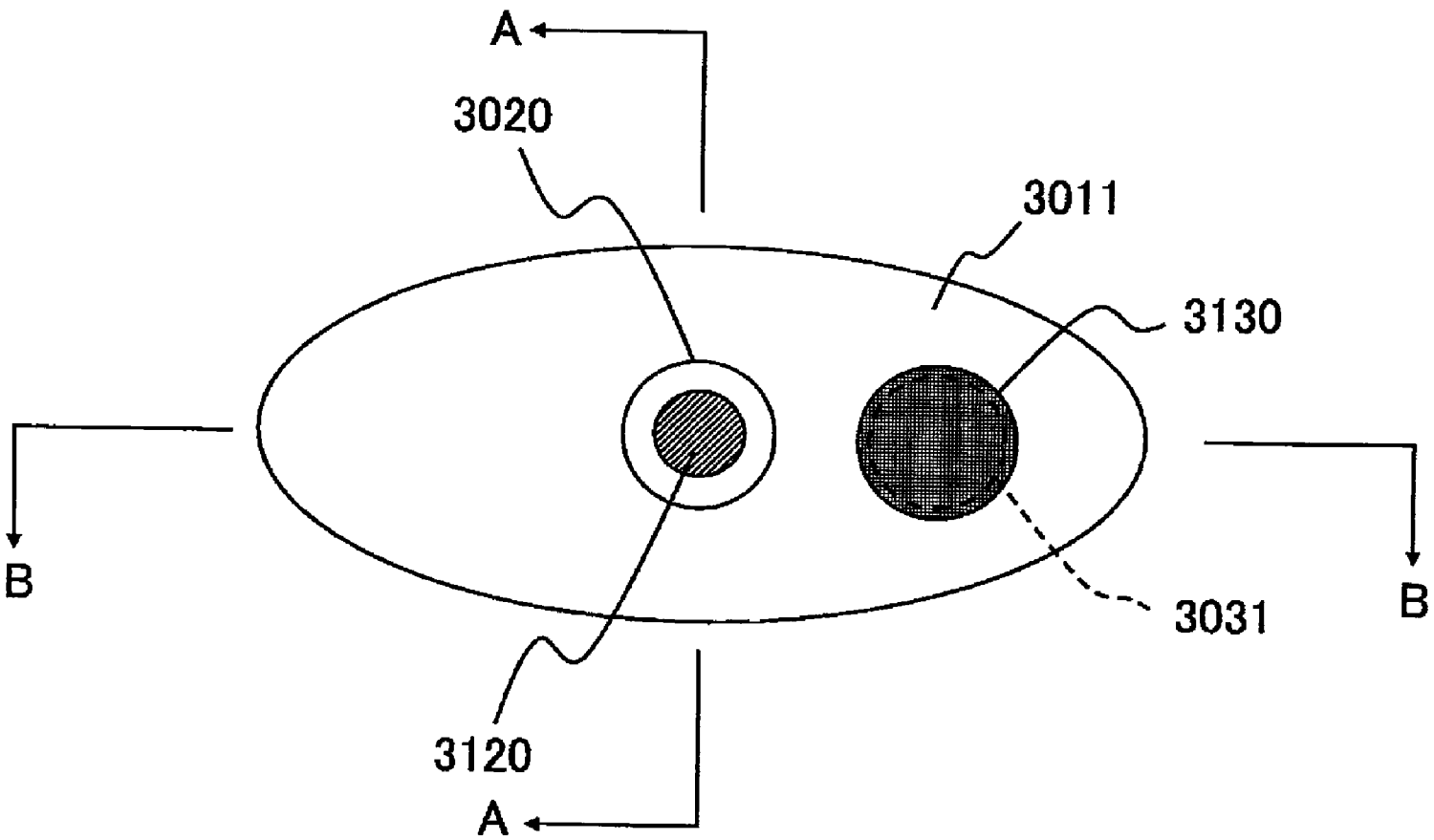
FIG. 13 is a front view of the ink container of FIG. 11, as seen from a direction along an arrow C of FIG. 11, according to an embodiment of the present invention.
Figures 14A, 14B:
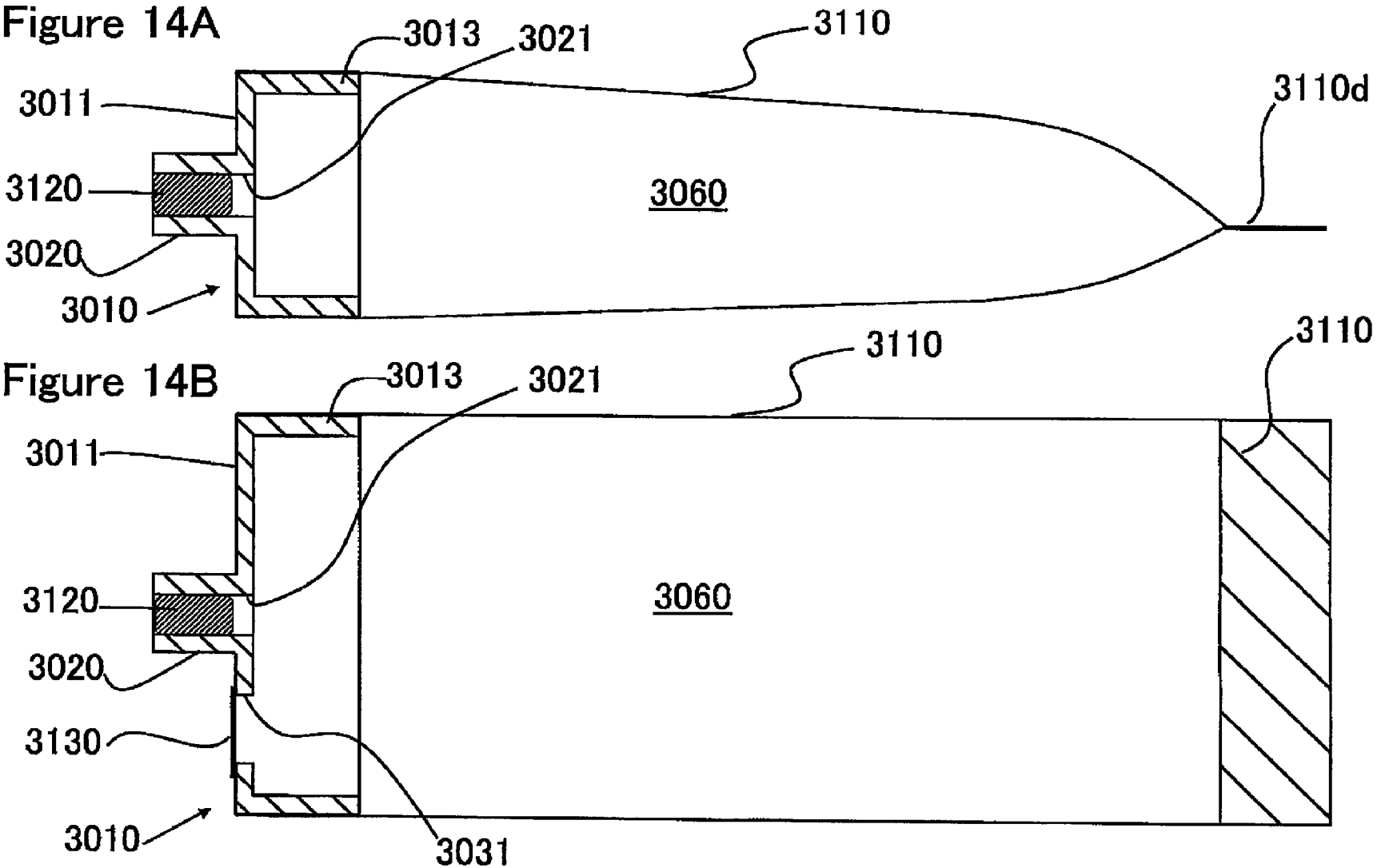
FIG. 14A is a cross-sectional view of the ink container of FIG. 11, taken along line A-A of FIG. 13, according to an embodiment of the present invention.
FIG. 14B is a cross-sectional view of the ink container of FIG. 11 taken along line B-B of FIG. 13, according to an embodiment of the present invention.

An ink container 2100 according to another embodiment of the present invention is described herein with reference to FIGS. 10A and 10B. Ink container 2100 may be substantially similar to ink container 100. Therefore, only the differences between ink container 2100 and ink container 100 are discussed with respect to ink container 2100.

A substantially circular opening 2011*a* may be formed in ink container 2100. A sloping wall 2012 may extend radially inwardly from an edge of opening 2011*a*, and may be in a shape of a bowl. When the pressure difference (P2–P1) reaches a first threshold value, flexible film 110 may begin deforming toward a bottom of bowl-shaped sloping wall 2012. When the amount of ink stored within ink chamber 2060 is reduced, film 110 may contact sloping wall 2012 along the bowl-shape as shown in FIG. 10B. In this state, the volumetric capacity of ink chamber 2060 may not decrease further, and film 110 may not deform further.

If the amount of ink within ink chamber 2060 is further reduced, the interior pressure of ink chamber 2060 may decrease, but film 110 may not further deform to offset the decrease of the interior pressure. Accordingly, the interior pressure may continue to decrease, reaching a level sufficient to cause detection film 130 to deform. More specifically, when the pressure difference (P4–P3) reaches the second threshold value, detection film 130 may begin deforming.

An ink container 3100 according to still another embodiment of the present invention is described herein with reference to FIGS. 11 to 14B.

Ink container 3100 may be configured to be accommodated in an appropriate case to provide an ink cartridge. Ink container 3100 may comprise a flexible sheet portion 3110 and also may comprise a base portion 3010. Base portion 3010 may comprise an elliptical wall 3011 and a peripheral wall 3013 extending from an outer edge of elliptical wall 3011. Base portion 3101 may further comprise an ink outlet portion 3020 extending from a center of elliptical wall 3011. Peripheral wall 3013 and ink outlet portion 3020 extend from elliptical wall 3011 in opposite directions.

Flexible sheet portion 3110 may be formed from a cylindrical flexible sheet 3110*a*. Cylindrical flexible sheet 3110*a* may have a first end portion 3110*b* and a second end portion 3110*c* opposite first end portion 3110*b*. An inner surface of first end portion 3110*b* may be welded to an outer surface of peripheral wall 3013, and a second end portion 3110*c* may be fused to form a junction 3110*d* to close second end portion 3110*c*. Thus, flexible sheet portion 3110 may be formed. Cylindrical flexible sheet 3110*a* may be a film comprising at least two flexible layers. One layer may comprise nylon and the other layer may comprise polyethylene, which may be the same material as base portion 3010. Additional layers may be added, for example, to reinforce the rigidity of flexible sheet portion 3110.

An inner space, which may be defined at least by flexible sheet portion 3110, peripheral wall 3013, and elliptical wall 3011, may serve as an ink chamber 3060 configured to store ink.

Ink outlet portion 3020 may comprise an ink outlet passage 3021 formed therethrough. Ink outlet passage 3021 extends from ink chamber 3060 and opens to an outside at an end of ink outlet portion 3020. A plug 3120 may comprise rubber and may be press-fitted in ink outlet passage 3021. A hollow needle provided in an inkjet printer may pierce through plug 3120, and ink within ink chamber 3060 may be supplied to the inkjet printer through the hollow needle. When the hollow needle is removed from plug 3120, the elasticity of the material comprising plug 3120 may allow the hole produced by the insertion of the hollow needle to be closed.

A hole 3031 may be formed through elliptical wall 3011 and a flexible sheet member 3130 may adhere to an outer surface of elliptical wall 3011 to cover hole 3031. Flexible sheet member 3130 may comprise rubber, and may have aluminum foil adhering to an outer surface of the rubber. Flexible sheet member 3130 also may be configured to reflect light, partially due to the aid of aluminum foil.

Flexible sheet portion 3110 may have an inner surface facing an interior of ink container 3100, e.g. facing ink chamber 3060, and an outer surface opposite the inner surface and facing an exterior of ink container 3100. Flexible sheet member 3130 may have an inner surface facing the interior of ink container 3100, e.g. facing ink chamber 3060, and have an outer surface opposite the inner surface and facing the exterior of ink container 3100. There may be a pressure difference between a pressure P1 acting on the inner surface of flexible sheet portion 3110 and a pressure P2 acting on the outer surface of flexible sheet portion 3110, e.g., the atmospheric pressure. When the pressure difference (P2–P1) reaches a first threshold value, flexible sheet portion 3110 may begin deforming so as to decrease the volumetric capacity of ink chamber 3060. There also may be a pressure difference (P4–P3) between a pressure P3 acting on the inner surface of flexible sheet member 3130 and a pressure P4 acting on the outer surface of flexible sheet member 3130, e.g., the atmospheric pressure. When the pressure difference (P4–P3) reaches a second threshold value, flexible sheet member 3130 may begin deforming into hole 3031, toward the interior of ink container 3100. The second threshold value may be greater than the first threshold value.

As ink within ink chamber 3060 is supplied to the inkjet printer through ink outlet passage 3021, the interior pressure of ink chamber 3060 may decrease. Flexible sheet portion 3110 may begin deforming when the pressure difference (P2–P1) reaches the first threshold value in order to maintain the interior pressure of ink chamber 3060, or to offset the decrease of the interior pressure. Because the second threshold value may be greater than the first threshold value, even when flexible sheet portion 3110 begins deforming, flexible sheet member 3130 may not deform.

When ink within ink chamber 3060 is further reduced, flexible sheet portion 3110 may no longer deform in such a direction which may cause volumetric capacity of ink chamber 3060 to decrease. In this state, if an amount of ink within ink chamber 3060 is further reduced, the interior pressure of ink chamber 3060 may continue to decrease, but flexible sheet portion 3110 may not further deform to offset the decrease of the interior pressure. Accordingly, the interior pressure may continue to decrease, and the pressure difference (P4–P3) may reach the second threshold value. When the pressure difference (P4–P3) reaches the second threshold value, flexible sheet member 3130 may begin deforming into hole 3031, toward the interior of ink container 3100.

By detecting the deformation of flexible member 3130 with light irradiation in a similar manner to the above-described embodiments, it may be determined that ink container 3100 may be empty.

Figure 15:
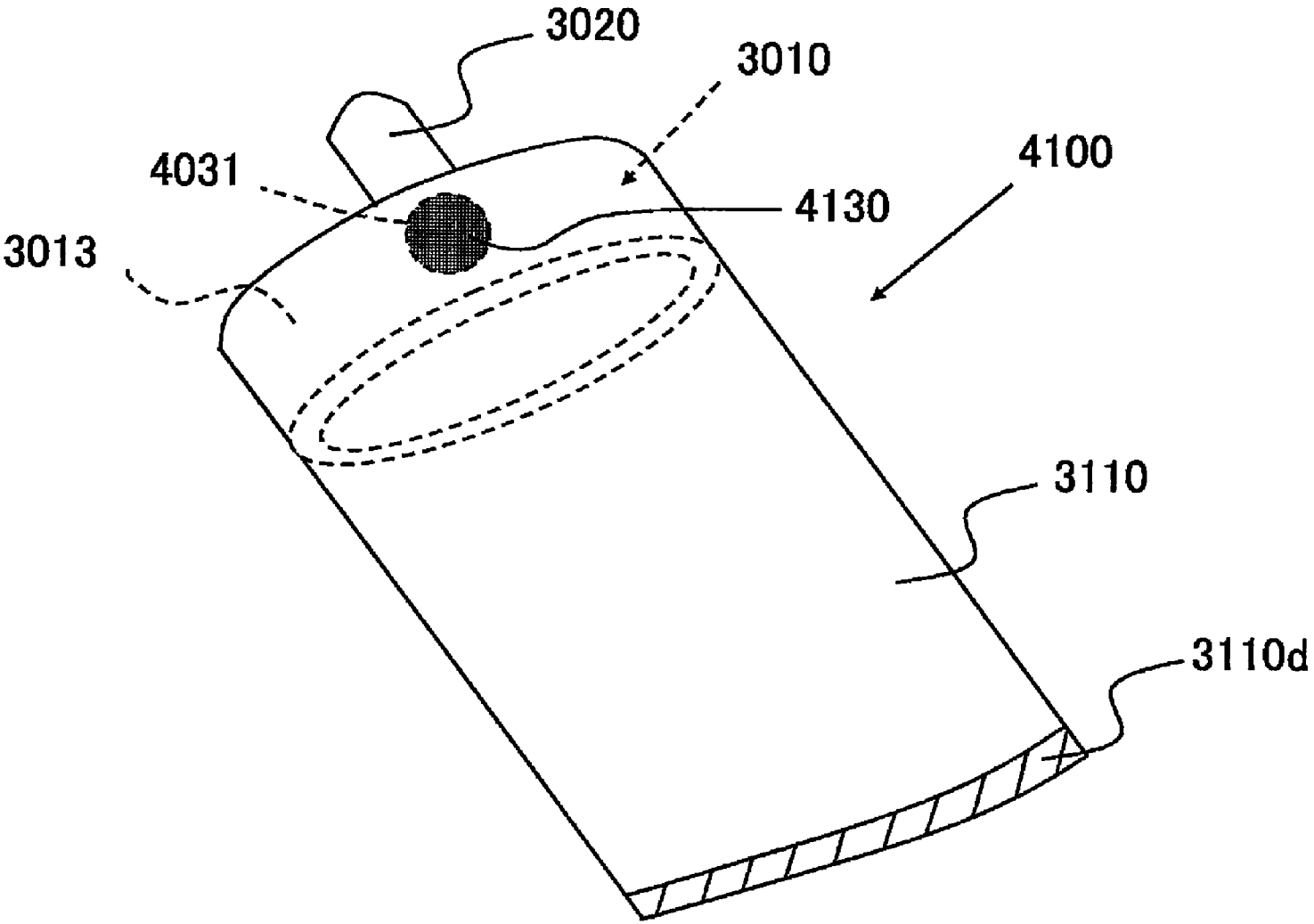
FIG. 15 is a perspective view of an ink container, according to a further embodiment of the present invention.
Figure 16:
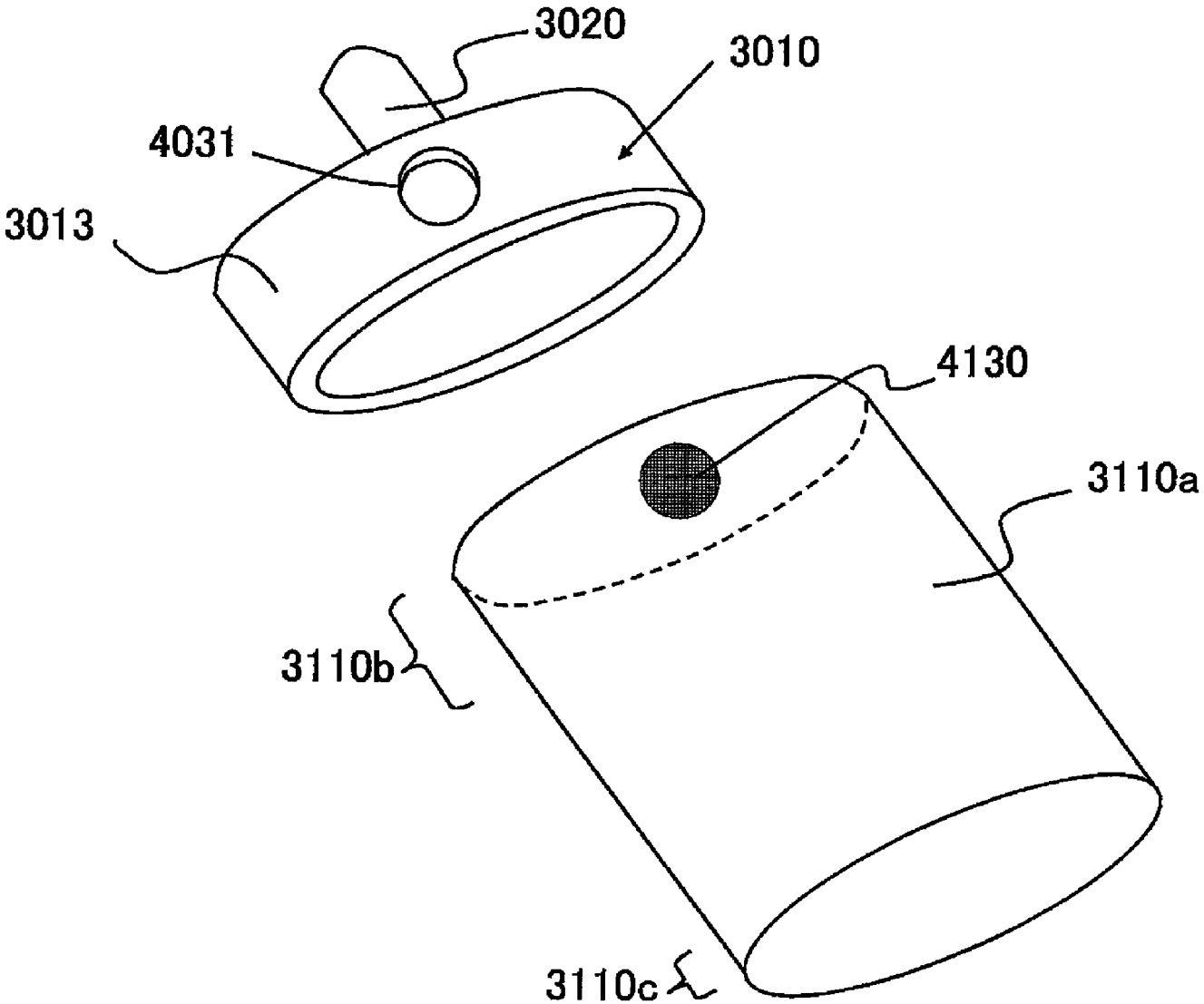
FIG. 16 is a perspective view of a base portion and cylindrical flexible sheet used to form the ink container of FIG. 15, according to an embodiment of the present invention.

An ink container 4100 according to further embodiment of the present invention is described herein with reference to FIGS. 15 and 16. Ink container 4100 may be substantially similar ink container 3100. Therefore, only the differences between ink container 4100 and ink container 3100 are discussed with respect to ink container 4100.

Elliptical wall 3011 of base portion 3010 of ink container 4100 may not have any holes formed therethrough. Peripheral wall 3013 of base portion 3010 of ink container 4100 may have a hole 4031 formed therethrough, and hole 4031 may be covered by first end portion 3110*b* of cylindrical flexible sheet 3110*a*. Aluminum film may be adhered to a portion 4130 of first end portion 3110*b* at a position corresponding to hole 4031.

Flexible sheet portion 3110 may have an inner surface facing an interior of ink container 4100, e.g. facing ink chamber 3060, and an outer surface, which is opposite the inner surface, faces an exterior of ink container 4100. Portion 4130 may have an inner surface facing the interior of ink container 4100, e.g. facing ink chamber 3060, and an outer surface which is opposite the inner surface, and which faces the exterior of ink container 4100. There may be a pressure difference (P2–P1) between the pressure P1 acting on the inner surface of flexible sheet portion 3110 and the pressure P2 acting on the outer surface of flexible sheet portion 3110, e.g., the atmospheric pressure. When the pressure difference (P2–P1) reaches a first threshold value, flexible sheet portion 3110 may begin deforming in order to decrease the volumetric capacity of ink chamber 3060. There also may be a pressure difference (P4–P3) between pressure P3 acting on the inner surface of portion 4130 and pressure P4 acting on the outer surface of portion 4130, e.g., the atmospheric pressure. When the pressure difference (P4–P3) reaches a second threshold value, portion 4130 may begin deforming into hole 4031, toward the interior of ink container 4100. The second threshold value may be greater than the first threshold value, and portion 4130 and flexible sheet portion 3100 may comprise the same material. The difference in threshold values may exist because a surface area of portion 4130 is less than a surface area of flexible sheet portion 3110.

As the amount of ink within ink chamber 3060 is reduced, the interior pressure of ink chamber 3060 may also decrease. Flexible sheet portion 3110 may begin deforming when the pressure difference (P2–P1) reaches the first threshold value in order to maintain the interior pressure of ink chamber 3060, or to offset the decrease of the interior pressure. Because the second threshold value may be greater than the first threshold value, even when flexible sheet portion 3110 begins deforming, portion 4130 may not deform.

When ink within ink chamber 3060 is further reduced, flexible sheet portion 3110 may not further deform in a direction which causes volumetric capacity of ink chamber 3060 to be reduced. In this state, if an amount of ink within ink chamber 3060 is further reduced, the interior pressure of ink chamber 3060 may decrease, but flexible sheet portion 3110 may not further deform to offset the decrease of the interior pressure. Accordingly, the interior pressure may continue to decrease, and the pressure difference (P4–P3) may reach the second threshold value. When the pressure difference (P4–P3) reaches the second threshold value, portion 4130 may begin deforming into hole 4031, toward the interior of ink container 4100.

By detecting the deformation of flexible member 4130 with light irradiation in a similar manner to the above-described embodiments, it may be determined that ink container 4100 may be empty.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A fluid cartridge comprising:

a fluid container comprising:

a fluid chamber configured to store a fluid;

a first passage configured to communicate with the fluid chamber via a first opening and configured to supply the fluid from an interior of the fluid chamber to an exterior of the fluid chamber;

a communication passage configured to communicate with the fluid chamber via a second opening and comprising a third opening opposite the second opening;

a first flexible sheet portion comprising a first surface facing an interior of the fluid container, and a second surface facing an exterior of the fluid container, wherein the first surface is opposite the second surface; and a second flexible sheet portion covering the third opening and comprising a third surface facing the interior of the fluid container and a fourth surface facing the exterior of the fluid container, wherein the third surface is opposite the fourth surface, wherein the first flexible sheet portion is configured to deform when a pressure acting on the second surface is greater than a pressure acting on the first surface and when a difference between the pressure acting on the first surface and the pressure acting on the second surface is greater than or equal to a first value, and the second flexible sheet portion is configured to deform when a pressure acting on the fourth surface is greater than a pressure acting on the third surface and when a difference between the pressure acting on the third surface and the pressure acting on the fourth surface is greater than or equal to a second value, wherein the second value is greater than the first value.

2. The fluid cartridge of claim 1, wherein a portion of the second flexible sheet portion is in a flexed position.

3. The fluid cartridge of claim 2, wherein the second flexible sheet portion comprises an annular protruding portion extending away from an adjacent area of the second flexible sheet portion.

4. The fluid cartridge of claim 3, wherein the annular protruding portion extends toward the interior of the fluid container.

5. The fluid cartridge of claim 1, further comprising a case enclosing the fluid container, wherein the case has a fourth opening and a fifth opening formed therethrough, wherein the fourth opening is configured to be in fluid communication with the first passage, and the fifth opening is configured to provide fluid communication between the second flexible sheet portion and an exterior of the case.

6. The fluid cartridge of claim 5, wherein the case comprises a substantial flat end, and each of the fourth and fifth openings is positioned at the substantial flat end.

7. The fluid cartridge of claim 1, wherein the second flexible sheet portion is configured to reflect light.

8. The fluid cartridge of claim 1, wherein the second flexible sheet portion is configured to deform asymmetrically.

9. The fluid cartridge of claim 8, further comprising a regulation member configured to regulate a deformation of a predetermined portion of the second flexible sheet portion.

10. The fluid cartridge of claim 9, wherein the regulation member contacts the portion of the second flexible sheet portion.

11. The fluid cartridge of claim 1, wherein a surface area of the first flexible sheet portion is greater than a surface area of the second flexible sheet portion.

12. The fluid cartridge of claim 1, wherein the fluid container further comprises a particular wall having the third opening formed therethrough, and the second flexible sheet portion contacts the particular wall and covers the third opening.

13. The fluid cartridge of claim 12, wherein the fluid container further comprises a further wall having a sixth opening formed therethrough, and the first flexible sheet portion contacts the further wall and covers the sixth opening.

14. The fluid cartridge of claim 1, wherein each of the first flexible sheet portion and the second flexible sheet portion comprises a predetermined material.

15. The fluid cartridge of claim 1, wherein the fluid container further comprises a frame comprising:

the fluid chamber;

a fluid outlet portion comprising the first passage; and a detection portion comprising the communication passage.

16. A fluid amount detection system comprising:

a fluid cartridge comprising a fluid container, the fluid container comprising:

a fluid chamber configured to store a fluid;

a first passage configured to communicate with the fluid chamber via a first opening and configured to supply the fluid from an interior of the fluid chamber to an exterior of the fluid chamber;

a communication passage configured to communicate with the fluid chamber via a second opening and comprising a third opening opposite the second opening;

a first flexible sheet portion comprising a first surface facing an interior of the fluid container, and a second surface facing an exterior of the fluid container, wherein the first surface is opposite the second surface; and a second flexible sheet portion covering the third opening and configured to reflect light, and comprising a third surface facing the interior of the fluid container and a fourth surface facing the exterior of the fluid container, wherein the third surface is opposite the fourth surface, wherein the first flexible sheet portion is configured to deform when a pressure acting on the second surface is greater than a pressure acting on the first surface and when a difference between the pressure acting on the first surface and the pressure acting on the second surface is greater than or equal to a first value, and the second flexible sheet portion is configured to deform when a pressure acting on the fourth surface is greater than a pressure acting on the third surface and when a difference between the pressure acting on the third surface and the pressure acting on the fourth surface is greater than or equal to a second value, wherein the second value is greater than the first value;

a light emitting portion; and a light receiving portion, wherein the second flexible sheet portion is positioned such that, before the second flexible sheet portion deforms, a light emitted from the light emitting portion and reflected by the second flexible sheet portion reaches the light receiving portion.

17. A fluid cartridge comprising a fluid container comprising:

a fluid chamber configured to store a fluid;

a first passage configured to communicate with the fluid chamber via a first opening and configured to supply the fluid therethrough from an interior of the fluid chamber to an exterior of the fluid chamber;

a communication passage configured to communicate with the fluid chamber via a second opening and comprising a third opening opposite the second opening;

a first flexible sheet portion defining a first portion of an outer surface of the fluid container; and a second flexible sheet portion covering the third opening and defining a second portion of an outer surface of the fluid container, wherein a flexibility of the first flexible sheet portion is greater than a flexibility of the second flexible sheet portion.

18. The fluid cartridge according to claim 17, wherein the second flexible sheet portion is configured to reflect light.

19. The fluid cartridge of claim 17, wherein the fluid container further comprises a frame comprising:

the fluid chamber;

a fluid outlet portion comprising the first passage; and a detection portion comprising the communication passage.

20. A fluid amount detection system, comprising:

a fluid cartridge comprising a fluid container comprising:

a fluid chamber configured to store a fluid;

a first passage configured to communicate with the fluid chamber via a first opening and configured to supply the fluid therethrough from an interior of the fluid chamber to an exterior of the fluid chamber;

a communication passage configured to communicate with the fluid chamber via a second opening and comprising a third opening opposite the second opening;

a first flexible sheet portion defining a first portion of an outer surface of the fluid container; and a second flexible sheet portion covering the third opening and configured to reflect light, and defining a second portion of an outer surface of the fluid container, wherein a flexibility of the first flexible sheet portion is greater than a flexibility of the second flexible sheet portion;

a light emitting portion; and a light receiving portion, wherein the second flexible sheet portion is positioned such that before the second flexible sheet portion deforms, a light emitted from the light emitting portion and reflected by the second flexible sheet portion reaches the light receiving portion.

21. The fluid amount detection system of claim 20, wherein the second flexible sheet portion is positioned, such that after the second flexible sheet portion deforms, the light emitted from the light emitting portion and reflected by the second flexible sheet portion does not reach the light receiving portion.

* * * * *